US010940974B2

(12) United States Patent
Walling et al.

(10) Patent No.: US 10,940,974 B2
(45) Date of Patent: Mar. 9, 2021

(54) CARTON WITH INTEGRAL HANDLE AND PACKAGE

(71) Applicant: Westrock Packaging Systems, LLC, Norcross, GA (US)

(72) Inventors: Bradford J. Walling, Chesterfield, VA (US); Brandon L. Ramsuer, Henrico, VA (US); Caleb S. Loftin, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 450 days.

(21) Appl. No.: 14/916,478

(22) PCT Filed: Sep. 3, 2014

(86) PCT No.: PCT/US2014/053779
§ 371 (c)(1),
(2) Date: Mar. 3, 2016

(87) PCT Pub. No.: WO2015/034856
PCT Pub. Date: Mar. 12, 2015

(65) Prior Publication Data

US 2016/0194106 A1 Jul. 7, 2016

Related U.S. Application Data

(60) Provisional application No. 61/873,316, filed on Sep. 3, 2013.

(51) Int. Cl.
*B65D 71/36* (2006.01)
*B65D 5/468* (2006.01)

(52) U.S. Cl.
CPC ..... *B65D 5/4608* (2013.01); *B65D 71/36* (2013.01); *B65D 2571/005* (2013.01);
(Continued)

(58) Field of Classification Search
CPC ..... B65D 5/4608; B65D 71/36; B65D 2571/00728; B65D 71/00722;
(Continued)

(56) References Cited

U.S. PATENT DOCUMENTS 2,312,598 A * 3/1943 Sprague ..... B65D 5/4608 229/117.16
2,785,847 A * 3/1957 Forrer ..... B65D 5/46192 206/427
(Continued)

FOREIGN PATENT DOCUMENTS

DE 9006306 U1 9/1990
EP 0093302 A2 11/1983
(Continued)

*Primary Examiner* — J. Gregory Pickett
*Assistant Examiner* — Jenine Pagan
(74) *Attorney, Agent, or Firm* — Brian J. Goldberg

(57) ABSTRACT

A package includes a carton (10) and a plurality of articles (B). The carton includes carton walls (14, 16, 26*b*/30*b*) and at least one handle structure (HA2) formed from at least one (26*b*/30*b*) of the carton walls. The at least one handle structure includes a tab (44*b*) formed from the at least one of the carton walls. The tab is hingedly connected, by a hinged connection (42*b*), to the at least one of the carton walls and arranged to fold at least in part about an article disposed within the carton to form at least a portion of a handle opening (40*b*) so as to allow a user (U) to grasp a portion of the article and the carton disposed adjacent to the article.

18 Claims, 25 Drawing Sheets

(52) U.S. Cl.
CPC ..... *B65D 2571/0045* (2013.01); *B65D 2571/0066* (2013.01); *B65D 2571/00141* (2013.01); *B65D 2571/00722* (2013.01); *B65D 2571/00728* (2013.01)

(58) Field of Classification Search
CPC ..... B65D 71/0045; B65D 2571/00141; B65D 2571/0066; B65D 2571/0045; B65D 2571/005
USPC ..... 206/434, 435, 427; 229/117.12–117.17, 229/117.24
See application file for complete search history.

(56) References Cited

U.S. PATENT DOCUMENTS 3,269,531 A * 8/1966 Weiss ..... B65D 71/16 206/152
3,412,852 A * 11/1968 Naumann, Jr. ..... B65D 71/16 206/148
3,593,849 A 7/1971 Helms et al.
3,750,874 A * 8/1973 Detzel ..... B65D 71/20 206/141
3,807,624 A * 4/1974 Funkhouser ..... B65D 71/36 206/427
3,952,940 A 4/1976 Malcolm
3,994,432 A 11/1976 Kirby
4,284,195 A 8/1981 Champlin
4,327,861 A 5/1982 Thompson
4,397,416 A * 8/1983 Bishop ..... B65D 71/36 206/141
4,621,766 A * 11/1986 McClure ..... B65D 5/28 229/117.17
4,919,266 A * 4/1990 McIntosh, Jr. ..... B65D 71/14 206/427
4,981,253 A * 1/1991 Quaintance ..... B65D 5/4608 206/141
5,395,044 A * 3/1995 Stout ..... B65D 71/36 229/117.13
7,273,161 B2 * 9/2007 Fogle ..... B65D 5/4608 229/117.13
7,870,993 B2 * 1/2011 Walling ..... B65D 5/0227 206/427
9,033,210 B2 * 5/2015 Kastanek ..... B65D 71/36 206/427
2007/0017966 A1 1/2007 Debusk
2007/0039846 A1 * 2/2007 Spivey, Sr. ..... B65D 71/36 206/427
2011/0233091 A1 * 9/2011 Block ..... B65D 5/0227 206/427
2011/0290867 A1 * 12/2011 Schemmel ..... B65D 71/36 229/117.13
2012/0091190 A1 * 4/2012 Smalley ..... B65D 71/14 229/117.13
2012/0312866 A1 * 12/2012 Walling ..... B65D 71/36 229/117.12
2013/0264379 A1 * 10/2013 Schemmel ..... B65D 5/4608 229/117.16

FOREIGN PATENT DOCUMENTS

EP 0391623 A1 10/1990
WO WO97/35781 10/1997
WO WO97/35781 A1 10/1997
WO WO2009/043056 A2 2/2009
WO WO2012/161592 A2 11/2012
WO WO2013/177239 A1 11/2013

* cited by examiner

CARTON WITH INTEGRAL HANDLE AND PACKAGE

CROSS REFERENCE TO RELATED APPLICATIONS

This application a National Phase application of PCT Application PCT/US2014/053779 filed Sep. 3, 2014, which claims the benefit of U.S. Provisional Patent Application No. 61/873,316 filed Sep. 3, 2013, each of which is incorporated herein by reference in its entirety.

TECHNICAL FIELD

The present invention relates to a carton and to a blank for forming the carton more specifically, but not exclusively, to a carton having a carrying handle.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carrying handle so that a consumer may transport the package from a retail outlet. It is desirable that the carrying handle is both comfortable to use and strong enough to bear the load of the package contents.

The present invention seeks to overcome or at least mitigate the problems of the prior art.

SUMMARY

According to a first aspect of the present invention there is provided a carrying handle for a carton comprising a plurality of panels wherein the carrying handle comprises a handle structure struck from at least one of the plurality of panels, the handle structure comprising a tab struck from the at least one of the plurality of panels, the tab being hingedly connected, by a hinged connection, to the at least one of the plurality of panels and arranged to fold at least in part about an article disposed in the carton to form at least in part a first handle opening so as to allow a user to grasp a portion of the carton disposed adjacent to the article and the article to carry the carton.

In some embodiments, the article is substantially tubular and comprises tubular axis and wherein the hinged connection is orientated in parallel with the tubular axis of the article.

Preferably, the tab comprises a first fold line for facilitating folding of the tab about the article.

Preferably, the tab is hingedly connected to a first one of said plurality of panels and the handle structure comprises a web panel coupling the tab to a second one of the plurality of panels, the second one of the plurality of panels being disposed adjacent to the first one of said plurality of panels.

In some embodiments, the second one of the plurality of panels being is disposed substantially perpendicularly to the first one of said plurality of panels.

Optionally, a thumb opening is provided in a third one of said plurality of panels, third the one of the plurality of panels being disposed adjacent to the first one of said plurality of panels.

Preferably, the thumb opening is defined at least in part by a thumb tab, the thumb tab being at least partially detachable from the third the one of the plurality of panels.

Preferably, the thumb opening is defined at least in part by a thumb tab, the thumb tab being hingedly connected to the third the one of the plurality of panels.

In some embodiments, the thumb opening is arranged such that in use a user inserts a thumb of one hand into the thumb opening and at least one finger of the same hand into the first handle opening.

A lower edge of the tab may be shaped so as to accommodate a portion of the article when the tab is folded internally of the carton.

Preferably, a lower edge of the tab is defined by an aperture, the aperture forming part of the first handle opening, the aperture being struck from at least one of the plurality of panels.

In some embodiments, the tab comprises a fold line extending transversely there across so as allow a lower portion of the tab to fold about a portion of the article when the tab is folded internally of the carton.

Preferably, a side edge of the tab is defined by an aperture, the aperture forming part of the first handle opening, the aperture being struck at least from the at least one of the plurality of panels.

In some embodiments, at least a portion of the upper edge of the tab is defined by an aperture, the aperture forming part of the handle opening the aperture being struck at least from a second one of the plurality of panels, the second one of the plurality of panels being disposed adjacent to the at least one of the plurality of panels, such that the first handle opening is defined in the at least one of the plurality of panels and in the second one of the plurality of panels.

In some embodiments, the handle structure comprises an extension panel hingedly connected to the tab and struck at least in part form a second one of the plurality of panels, the second one of the plurality of panels being disposed adjacent to the at least one of the plurality of panels.

The extension panel may be coupled to the second one of the plurality of panels by a hinge line.

The extension panel may be coupled to the web panel by a severance line.

In some embodiments, the at least one of the plurality of panels is a composite panel formed from two or more panels disposed in at least partial overlapping relationship with one another, a first one of the two or more panels comprising the tab and a second one of the two or more panels comprises a cutaway arranged in registry with the tab so as to allow the tab to pass through the second one of the two or more panels when folded.

In some embodiments, the handle structure comprises a second tab struck from the at least one of the plurality of panels, the second tab being hingedly connected, by a hinged connection, to the at least one of the plurality of panels and arranged to fold with respect to the at least one of the plurality of panels to form the first handle opening.

Preferably, the handle structure comprises a second handle structure including a second tab struck from at least a second one of the plurality of panels, the second tab being hingedly connected, by a hinged connection, to the at least a second one of the plurality of panels and arranged to fold with respect to the at least a second one of the plurality of panels to form a second handle opening, the at least a second one of the plurality of panels being disposed adjacent to the at least one of the plurality of panels such that a user may insert a thumb of one hand into the first handle opening and at least one finger of the same hand into the second handle opening.

In some embodiments, the at least one of the plurality of panels is a composite panel formed from two or more panels disposed in at least partial overlapping relationship with one another, a first one of the two or more panels comprising the a first portion tab and a second one of the two or more panels comprises a cutaway arranged in registry with the tab so as to allow the tab to pass through the second one of the two or more panels when folded.

According to a second aspect of the present invention there is provided a carton comprising the carrying handle of the foregoing paragraphs wherein a handle structure is struck from an end wall of the carton.

According to a third aspect of the present invention there is provided a carton comprising the carrying handle as described hereinabove wherein a handle structure is struck from a side wall of the carton.

According to a fourth aspect of the present invention there is provided a carton comprising the carrying handle as described hereinabove wherein a first handle structure is struck from an end wall and second handle structure is struck from an adjacent side wall of the carton.

Preferably, the carton comprises a corner panel disposed between the end wall and the adjacent side wall.

According to a fifth aspect of the present invention there is provided a carton comprising the carrying handle as described hereinabove the carton comprising side walls and end walls, wherein a handle structure is struck from each of the side walls and end walls.

Preferably, the carton comprises a corner panel disposed between each end wall and the adjacent side wall.

According to a sixth aspect of the present invention there is provided package comprising a carton and a plurality of articles, the carton comprising a plurality of walls including a top wall, base wall, first side wall, second side wall, first end wall and second end wall, the carton comprising at least one handle structure struck from at least one of the plurality of walls, the at least one handle structure comprising a tab struck from the at least one of the plurality of walls, the tab being hingedly connected, by a hinged connection, to the at least one of the plurality of walls and arranged to fold at least in part about an article disposed within the carton to form at least a portion of a handle opening so as to allow a user to grasp a portion of the carton disposed adjacent to the article and the article thereby forming a carrying handle.

According to a seventh aspect of the present invention there is provided blank for forming a carton, the blank comprising a plurality of panels for forming a top wall, base wall, first side wall, second side wall, first end wall and second end wall, the blank comprising at least one handle structure struck from at least one of the plurality of panels, the at least one handle structure comprising a tab struck from the at least one of the plurality of panels, the tab being hingedly connected, by a hinged connection, to the at least one of the plurality of panels and in use the tab being arranged to fold at least in part about an article disposed within an assembled carton, thereby forming at least a portion of a handle opening so as to allow a user to grasp a portion of the carton disposed adjacent to the article and the article, whereby forming a carrying handle.

Within the scope of this application it is intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
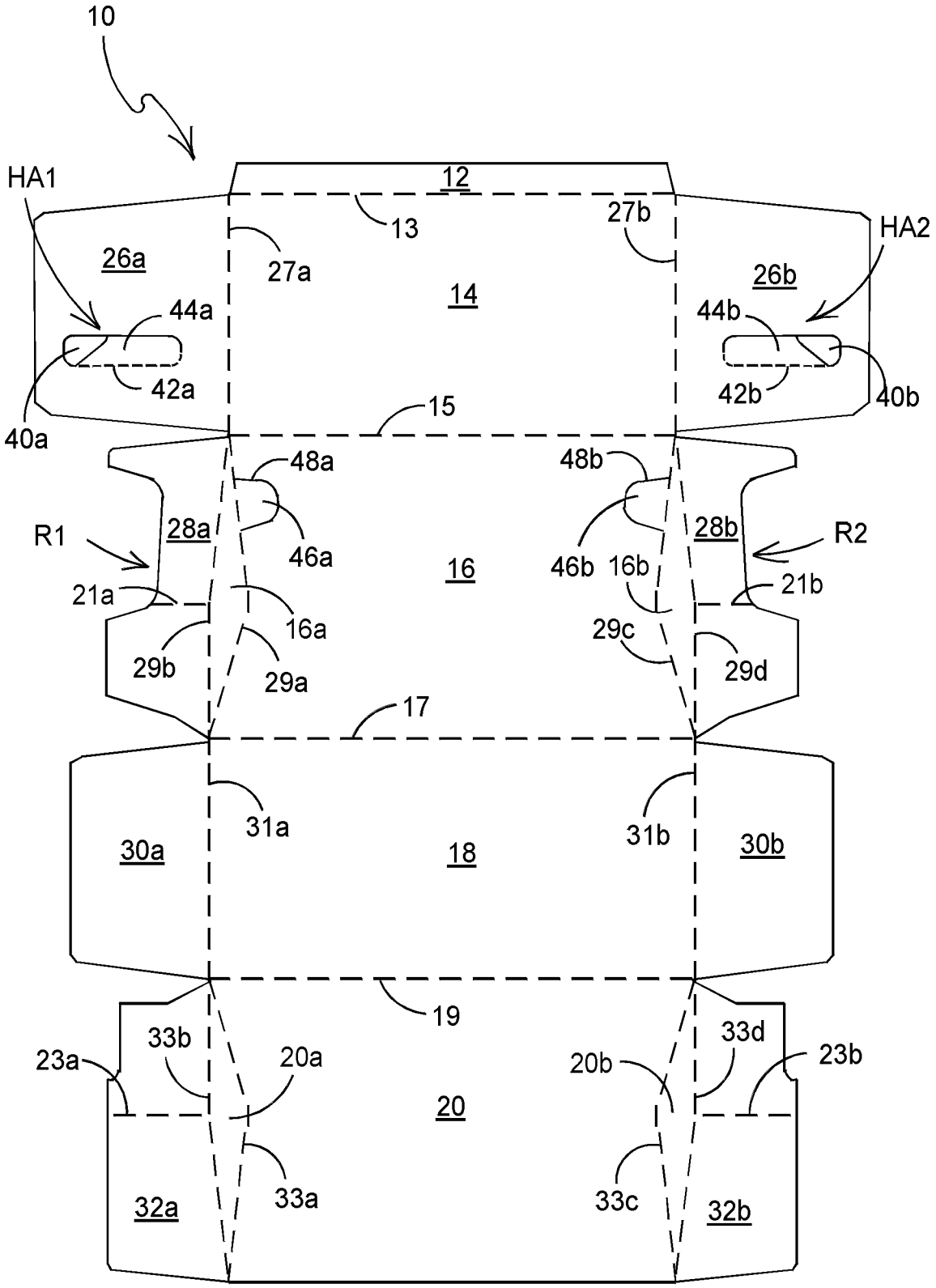
FIG. 1 is a plan view from above of a blank for forming a carton according to a first embodiment.
Figure 2:
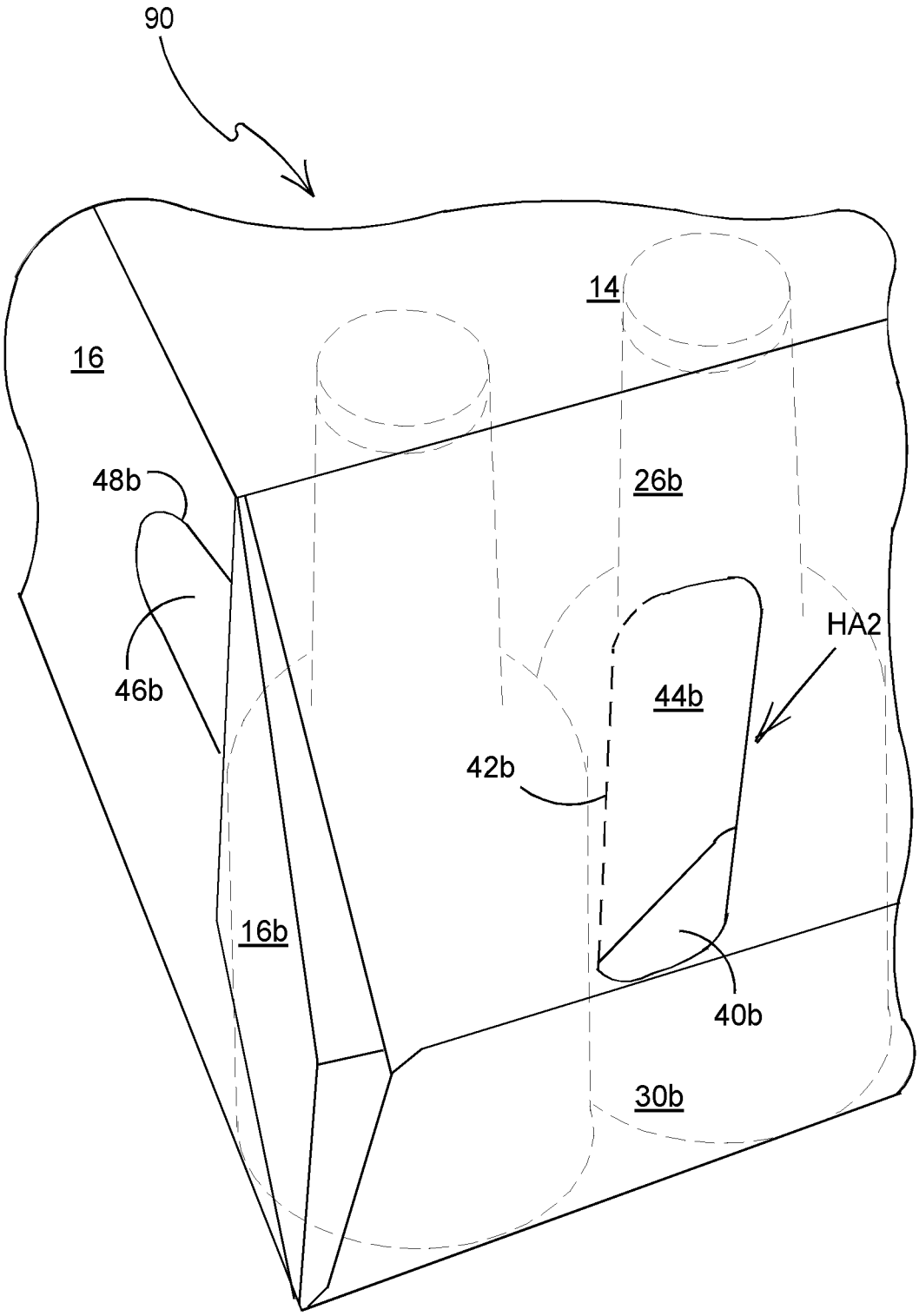
FIG. 2 is a perspective view from above of a portion of a carton formed from the blank of FIG. 1.

FIG. 1 shows a plan view of a blank 10 capable of forming a carton 90, as shown in FIG. 2, for primary products such as, but not limited to, bottles, hereinafter referred to as articles B.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blanks are configured to form a carton or carrier for packaging an exemplary arrangement of exemplary articles. In some of the illustrated exemplary embodiments, the arrangement is a 3×6 matrix or array of eighteen articles which are bottles, in one of the illustrated embodiments the arrangement is a 3×4 matrix or array of twelve bottles, in yet other illustrated embodiments the arrangement is a 2×2 matrix or array of four cans. The blank can be alternatively configured to form a carrier for packaging other types, number and size of article and/or for packaging articles in a different arrangement or configuration.

The blank 10 comprises a plurality of main panels 12, 14, 16, 18, 20 hingedly connected one to the next in a linear series. The blank 10 comprises a glue panel 12 hingedly connected to a top panel 14 by a fold line 13. The top panel 14 is hingedly connected to a first side panel 16 by a fold line 15. The first side panel 16 is hingedly connected to a base panel 18 by a fold line 17. The base panel 18 is hingedly connected to a second side panel 20 by a fold line 19.

The plurality of main panels 12, 14, 16, 18, 20 of the blank 10 form an open ended tubular structure in a set-up condition.

Each of the ends of the tubular structure is at least partially closed by end closure panels. In the illustrated embodiment the ends of the tubular structure are fully closed by end closure panels 26*a*, 28*a*, 30*a*, 32*a*, 26*b*, 28*b*, 30*b*, 32*b*.

End closure panels 26*a*, 28*a*, 30*a*, 32*a* are configured to close a first end of the tubular structure and end panels 26*b*, 28*b*, 30*b*, 32*b* are configured to close a second end of the tubular structure.

A first end closure panel 26*a* is hingedly connected to a first end of top panel 14 by a fold line 27*a*. A second end closure panel 28*a* is hingedly connected to a first end of first side panel 16 by a pair of fold lines 29*a*, 29*b*. A third end closure panel 30*a* is hingedly connected to a first end of base panel 18 by a fold line 31*a*. A fourth end closure panel 32*a* is hingedly connected to a first end of the second side panel 20 by a pair of fold lines 33*a*, 33*b*. The pair of fold lines 29*a*, 29*b* define first corner panel 16*a* disposed between the first side panel and the second end closure panel 28*a*. The pair of fold lines 33*a*, 33*b* define second corner panel 20*a* disposed between the second side panel and the fourth end closure panel 32*a*.

A fifth end closure panel 26*b* is hingedly connected to a second end of top panel 14 by a fold line 27*b*. A sixth end closure panel 28*b* is hingedly connected to a second end of the first side panel 16 by a pair of fold lines 29*c*, 29*d*. A seventh end closure panel 30*b* is hingedly connected to a second end of base panel 18 by a fold line 31*b*. An eighth end closure panel 32*b* is hingedly connected to a second end of second top panel 18 by a pair of fold lines 33*c*, 33*d*.

The pair of fold lines 29*c*, 29*d* define third corner panel 16*b* disposed between the first side panel and the sixth end closure panel 28*b*. The pair of fold lines 33*c*, 33*d* define fourth corner panel 20*b* disposed between the second side panel and the eighth end closure panel 32*b*.

The second end closure panel 28*a* and the fourth end closure panel 32*a* each form a minor side end closure panel. The sixth end closure panel 28*b* and the eighth end closure panel 32*b* form a minor side end closure panel.

The first end closure panel 26*a* and the fifth end closure panel 26*b* each form a major upper end closure panel. The third end closure panel 30*a* and the seventh end closure panel 30*b* each form a major lower end closure panel.

The blank 10 comprises a first handle structure HA1 in the first end closure panel 26*a* and a second handle structure HA2 in the fifth end closure panel 26*b*. Each of the handle structures HA1, HA2 are substantially the same in construction, and each comprises a tab 44*a*, 44*b* struck from the respective one of the first end closure panel 26*a* or second end closure panel 26*b*. Each tab 44*a*, 44*b* is hingedly connected along an upper edge to the respective one of the first end closure panel 26*a* or second end closure panel 26*b* by a respective fold line 42*a*, 42*b*. In the illustrated embodiment each tab 44*a*, 44*b* defines in part an opening in the respective one of the first and second end closure panels 26*a*, 26*b* when the respective tab 44*a*, 44*b* is folded out of the plane of the first end closure panel 26*a* or second end closure panel 26*b*. Each opening is defined in part by an aperture 40*a*, 40*b* struck from the respective one of the first end closure panel 26*a* or second end closure panel 26*b*. Each opening provides a carrying handle for a user to insert their hand into the carton 90. Each of the tabs 44*a*, 44*b* provides a cushioning flap when folded internally of the carton 90 so as to provide a comfortable handle.

The second end closure panel 28*a* comprises a first cutaway or recess R1 struck from an end edge thereof. The first recess R1 is configured such that it is in alignment or registry with the tab 44*a* of the first handle structure HA1 or the opening defined in part by the tab 44*a* of the first handle structure HA1.

The sixth end closure panel 28*b* comprises a second cutaway or recess R2 struck from an end edge thereof. The second recess R2 is configured such that it is in alignment or registry with the tab 44*b* of the second handle structure HA2 or the opening defined in part by the tab 44*b* of the second handle structure HA2.

The second end closure panel 28*a* comprises an optional fold line 21*a* extending between fold line 29*b* and a free end edge of the second end closure panel 28*a*. The second end closure panel 28*a* can be folded about fold line 21*a* when closing the end of the carton 90.

The fourth end closure panel 32*a* comprises an optional fold line 23*a* extending between fold line 33*b* and a free end edge of the fourth end closure panel 32*a*. The fourth end closure panel 32*a* can be folded about fold line 23*a* when closing the end of the carton 90.

The sixth end closure panel 28*b* comprises an optional fold line 21*b* extending between fold line 29*d* and a free end edge of the sixth end closure panel 28*b*. The sixth end closure panel 28*b* can be folded about fold line 21*b* when closing the end of the carton 90.

The eighth end closure panel 32*b* comprises an optional fold line 23*b* extending between fold line 33*d* and a free end edge of the eighth end closure panel 32*b*. The eighth end closure panel 32*b* can be folded about fold line 23*b* when closing the end of the carton 90.

The first side panel 16 comprises an optional first thumb tab 46*a* defined in part by a severance line such as a first cutline 48*a* which is substantially U-shaped. Each end of the first cutline 48*a* terminates at the fold line 29*a* such that the first thumb tab 46*a* is hingedly connected to the carton 90. The first thumb tab 46*a* is provided in an upper portion of the first side panel 16 such that a user may engage the first thumb tab 46*a* and the first handle structure HA1 together.

The first side panel 16 comprises an optional second thumb tab 46*b* defined in part by a severance line such as a second cutline 48*b* which is substantially U-shaped. Each end of the second cutline 48*b* terminates at the fold line 29*c* such that the second thumb tab 46*b* is hingedly connected to the carton 90. The second thumb tab 46*b* is provided in an upper portion of the first side panel 16 such that a user may engage the second thumb tab 46*b* and the second handle structure HA2 together.

In alternative embodiments the first thumb tab 46*a* and the second thumb tab 46*b* may be replace with apertures or cutaways struck from the first side panel 16 such that a user may engage the respective one of the apertures or cutaways and the first or second handle structure HA1, HA2 together.

In alternative embodiments the first and second cut lines 48*a*, 48*b* may be severance lines.

Figure 3:
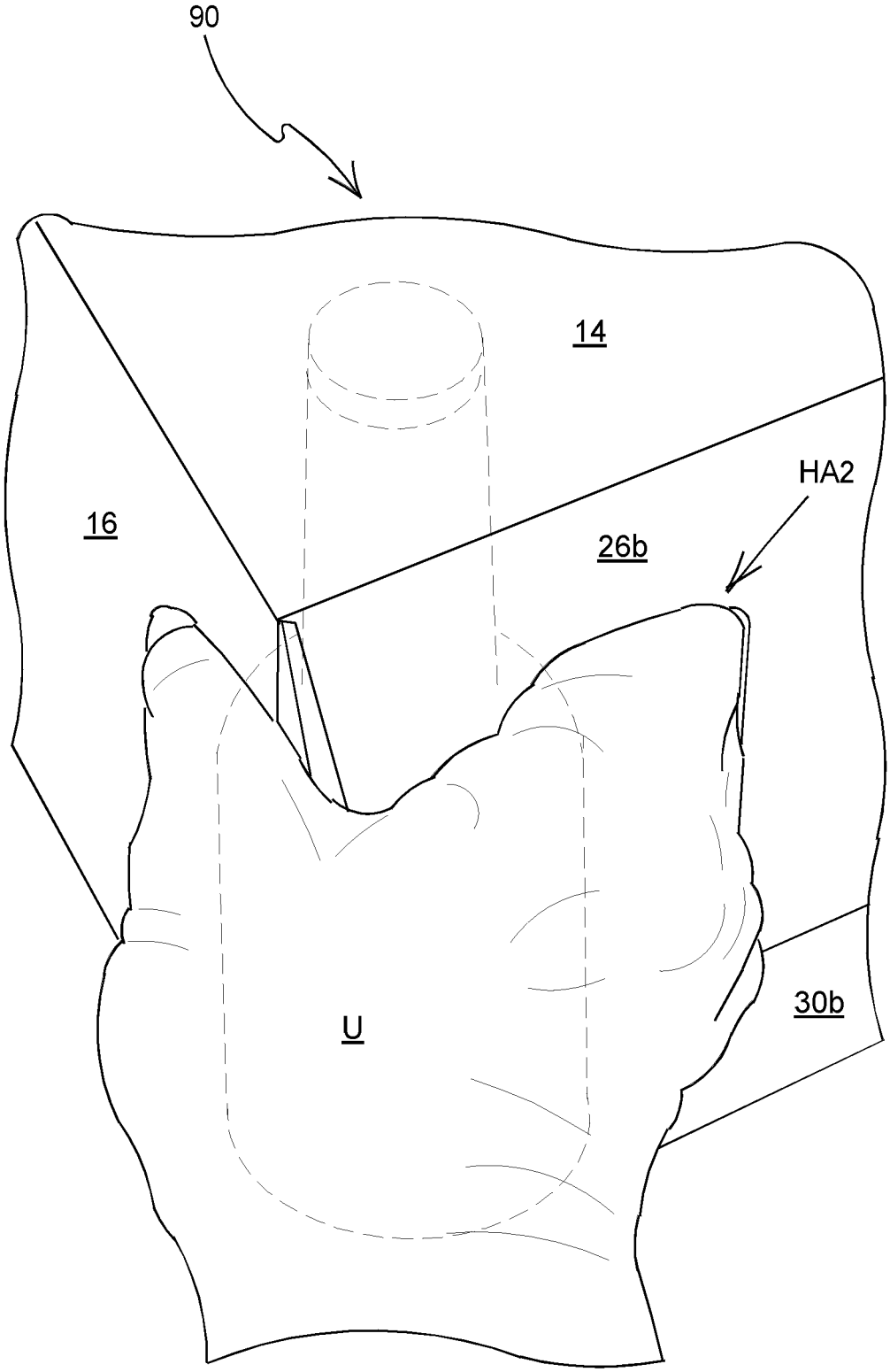
FIG. 3 is a perspective view from above of a portion of a carton formed from the blank of FIG. 1 showing the carrying handle in use.

Turning to the construction of the carton 90 as illustrated in FIGS. 2 and 3, the carton 90 can be formed by a series of sequential folding operations in a straight line machine so that the carton 90 is not required to be rotated or inverted to complete its construction. The folding process is not limited to that described below and may be altered according to particular manufacturing requirements.

The blank 10 is folded about fold line 15, such that the glue panel 12 and top panel 14 are folded thereabouts. The top panel 14 is brought into face contacting relationship with the first side panel 16; the glue panel 12 is brought into face contacting relationship with the base panel 18 and/or the first side panel 16.

Glue or other adhesive treatment is applied to the glue panel 12 or, in alternative embodiments, to a corresponding portion of the second side panel 20.

The second side panel 20 is folded about the fold line 19 such that the second side panel 22 overlies the glue panel 12.

The second side panel 20 is secured to the glue panel 12 to form a flat collapsed carton. The carton 90 may be shipped or distributed in this flat collapsed form.

In alternative embodiments the second side panel 20 may be secured to the glue panel 12 by alternative securing means for example, but not limited to, staples or other mechanical fixing means.

The flat collapsed carton 90 may be erected into a tubular structure by separating the top panel 14 from the base panel 16.

The carton 90, in its open ended tubular form, may be loaded with articles B through one or both open ends. It will be appreciated that in other embodiments one of the open ends of the carton 90 may be closed before loading the carton 90 with articles B through the remaining open end.

In some embodiments, some or all of the end closure panels 26*a*, 28*a*, 30*a*, 32*a*, 26*b*, 28*b*, 30*b*, 32*b* are folded outwardly to form a funnel at one or both ends of the carton 90 this facilitates loading of the articles B into the carton 90 and reduces the risk of the end closure panels 26*a*, 28*a*, 30*a*, 32*a*, 26*b*, 28*b*, 30*b*, 32*b* interfering with the articles B when they are being loaded.

Once the carton 90 is loaded with articles B the ends of the tubular structure are closed.

A first end of the tubular structure is closed by folding the second and fourth end closure panels 28*a*, 32*a* about fold lines 29*b*, 33*b* respectively.

Glue or other adhesive treatment may be applied to the second end closure panel 28*a* or in alternative embodiments to a corresponding portion of the third end closure panel 30*a*.

Glue or other adhesive treatment may be applied to the fourth end closure panel 32*a* or in alternative embodiments to a corresponding portion of the third end closure panel 30*a*.

The third end closure panel 30*a* is then folded about the fold line 31*a* to be brought into contact with the second and fourth end closure panels 28*a*, 30*a* and optionally secured thereto.

Glue or other adhesive treatment may be applied to the second end closure panel 28*a* or in alternative embodiments to a corresponding portion of the first end closure panel 26*a*.

Glue or other adhesive treatment may be applied to the fourth end closure panel 32*a* or in alternative embodiments to a corresponding portion of the first end closure panel 26*a*.

Glue or other adhesive treatment is applied to an inner surface of the first end closure panel 26*a* or in alternative embodiments to an outer surface of the third end closure panel 30*a*.

The first end closure panel 26*a* is then folded about the fold line 27*a* to be brought into contact with the second and fourth end closure panels 28*a*, 32*a* and the third end closure panel 30*a*.

The first end closure panel 26*a* is secured to the third end closure panel 30*a*. Optionally, the first end closure panel 26*a* is secured to the second and fourth end closure panels 28*a*, 32*a*.

In alternative embodiments the first end closure panel 26*a* may be folded about fold line 27*a* prior to folding the third end closure panel 30*a* about fold line 31*a*, it will be appreciated that in such embodiments the third end closure panel 30*a* is disposed outermost.

A second end of the tubular structure is closed by folding the sixth and eighth end closure panels 28*b*, 32*a* about fold lines 29*d*, 33*d* respectively.

Glue or other adhesive treatment may be applied to the sixth end closure panel 28*b* or in alternative embodiments to a corresponding portion of the seventh end closure panel 30*b*.

Glue or other adhesive treatment may be applied to the eighth end closure panel 32*b* or in alternative embodiments to a corresponding portion of the seventh end closure panel 30*b*.

The seventh end closure panel 30*b* is then folded about the fold line 31*b* to be brought into contact with the sixth and eighth end closure panels 28*b*, 30*b* and optionally secured thereto.

Glue or other adhesive treatment may be applied to the sixth end closure panel 28*b* or in alternative embodiments to a corresponding portion of the fifth end closure panel 26*b*.

Glue or other adhesive treatment may be applied to the eighth end closure panel 32*b* or in alternative embodiments to a corresponding portion of the fifth end closure panel 26*b*.

Glue or other adhesive treatment is applied to an inner surface of the fifth end closure panel 26*b* or in alternative embodiments to an outer surface of the seventh end closure panel 30*b*.

The fifth end closure panel 26*b* is then folded about the fold line 27*b* to be brought into contact with the sixth and eighth end closure panels 28*b*, 32*b* and the seventh end closure panel 30*b*.

The first end closure panel 26*a* is secured to the third end closure panel 30*a*. Optionally, the first end closure panel 26*a* is secured to the second and fourth end closure panels 28*a*, 32*a*.

In alternative embodiments the fifth end closure panel 26*b* may be folded about fold line 27*b* prior to folding the seventh end closure panel 30*b* about fold line 31*b*, it will be appreciated that in such embodiments the seventh end closure panel 30*b* is disposed outermost.

FIGS. 2 and 3 illustrate a perspective view of an end portion of the carton 90. The second handle structure HA2 is illustrated along with the second thumb tab 46*b*, together they form a carrying handle.

The handle structure HA2 forms a handle opening when the tab 44*b* is folded internally of the carton 90. Preferably, the handle opening (and the tab 44*b*) is placed at a position generally aligned with a space or void disposed between an article disposed in the corner of the carton 90 and an adjacent article. In the illustrated embodiment in which the array or matrix of articles is greater than 2×2, then each handle opening may be located closer to the carton top than to the carton bottom and to one side of the carton 90 than to the other opposing side of the carton 90. Preferably, each handle opening is oriented such that the longitudinal axis of each handle opening extends along, if not parallel to, the cylindrical axis of the adjacent corner article.

The second thumb tab 46*b* forms a thumb opening when the second thumb tab 46*b* is folded internally of the carton 90. Preferably, the thumb opening (and the second thumb tab 46*b*) is placed at a position generally aligned with a space or void disposed between an article disposed in the corner of the carton 90 and an adjacent article.

As can been seen in FIG. 3 a user can place their hand about the corner of the carton 90. The user places a thumb over the second thumb tab 46*b* and press the second thumb tab 46*b* internally of the carton 90. The user press one or more of their fingers upon the tab 44*b*, folding the tab 44*b* internally of the carton 90 about the fold line 42*b*. The user inserts their thumb into the aperture created by displacement of the second thumb tab 46*b*. The user inserts one or more fingers into the aperture created by displacement of the tab 44*b*. The user then wraps their finger at least partially about the article disposed in the corner of the carton 90 adjacent to the corner panel 16*b*.

In this way the corner article forms a part of the carrying handle, the carrying handle is strengthened or reinforced by the corner article. The article is generally formed from materials, or shaped and configured so as to be a rigid article, or at least having greater rigidity than the carton 90. The user engages at least in part with the article and a comfortable handle structure is formed. The tabs 44*a*, 44*b* and the first and second thumb tabs 46*a*, 46*b* provide padding increasing the comfort to the user, the tabs 44*a*, 44*b* and the first and second thumb tabs 46*a*, 46*b* may in some embodiments be configured to shield the user from a portion of the article, for example a closure device such as a crown cork, so as to reduce the risk of injury to the user when employing the carrying handle.

A further advantage of the invention is that the user grasps an article having a depth or thickness greater than that of the sheet material from which the carton is formed. This may be particularly advantageous to users who have a weak grip or those whose range of finger movement is restricted.

The tab 44*a* is shaped at a lower edge such that a lower edge of the tab 44*a* may pass over a shoulder of the corner article. In this way the tab 44*a* can be readily brought to bear against a neck portion of the corner article.

Referring now to FIGS. 4 to 24, there is shown alternative embodiments of the present invention. In the second, third, fourth, fifth and sixth illustrated embodiments, like numerals have, where possible, been used to denote like parts, albeit with the addition of the prefix "100", "200", "300", "400", "500" or "600" to indicate that these features belong to the second, third, fourth, fifth and sixth embodiments. The alternative embodiments share many common features with the first embodiment and therefore only the differences from the embodiment illustrated in FIGS. 1 to 3 will be described in any greater detail.

Figure 4:
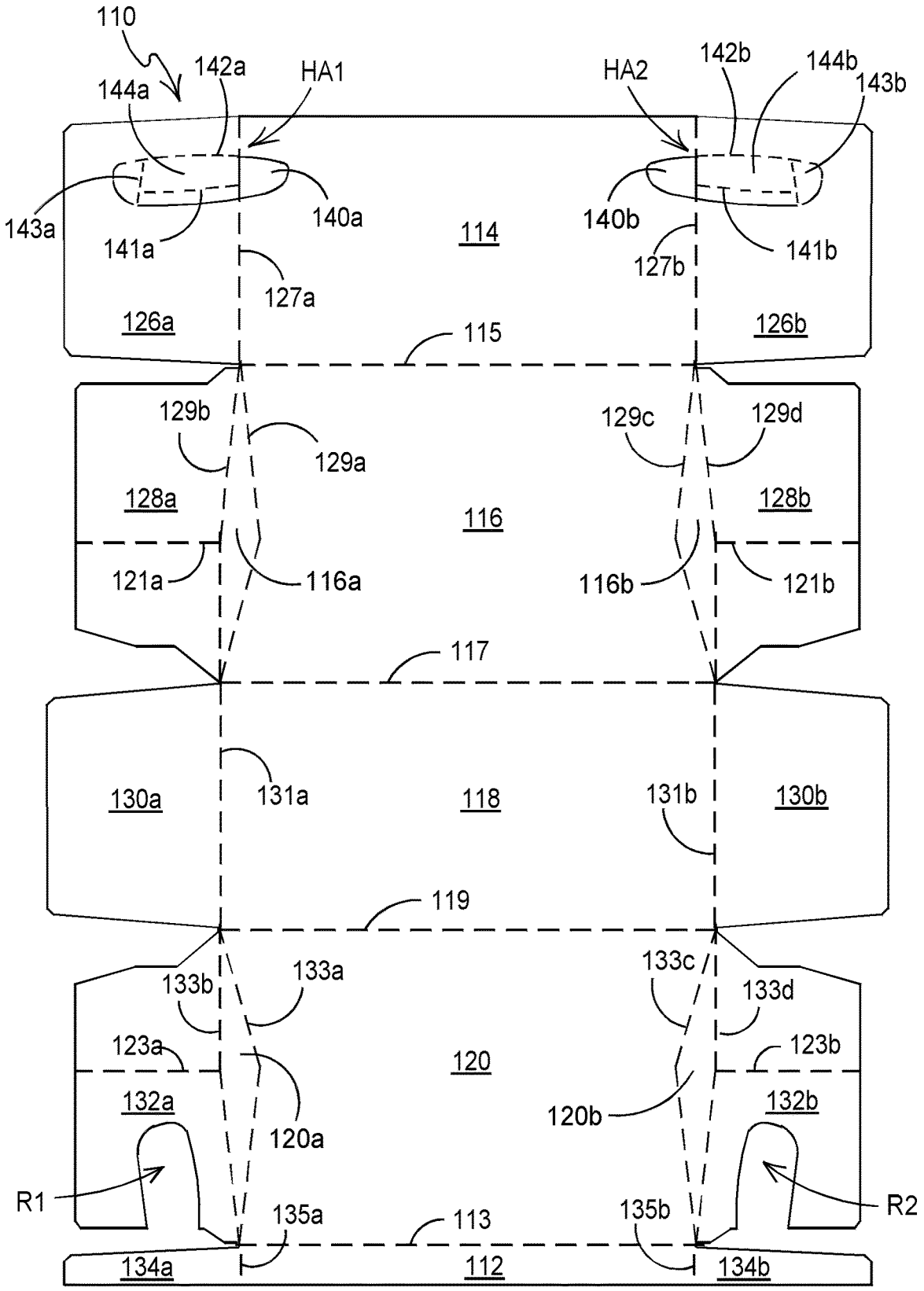
FIG. 4 is a plan view from above of a blank for forming a carton according to a second embodiment.
Figure 5:
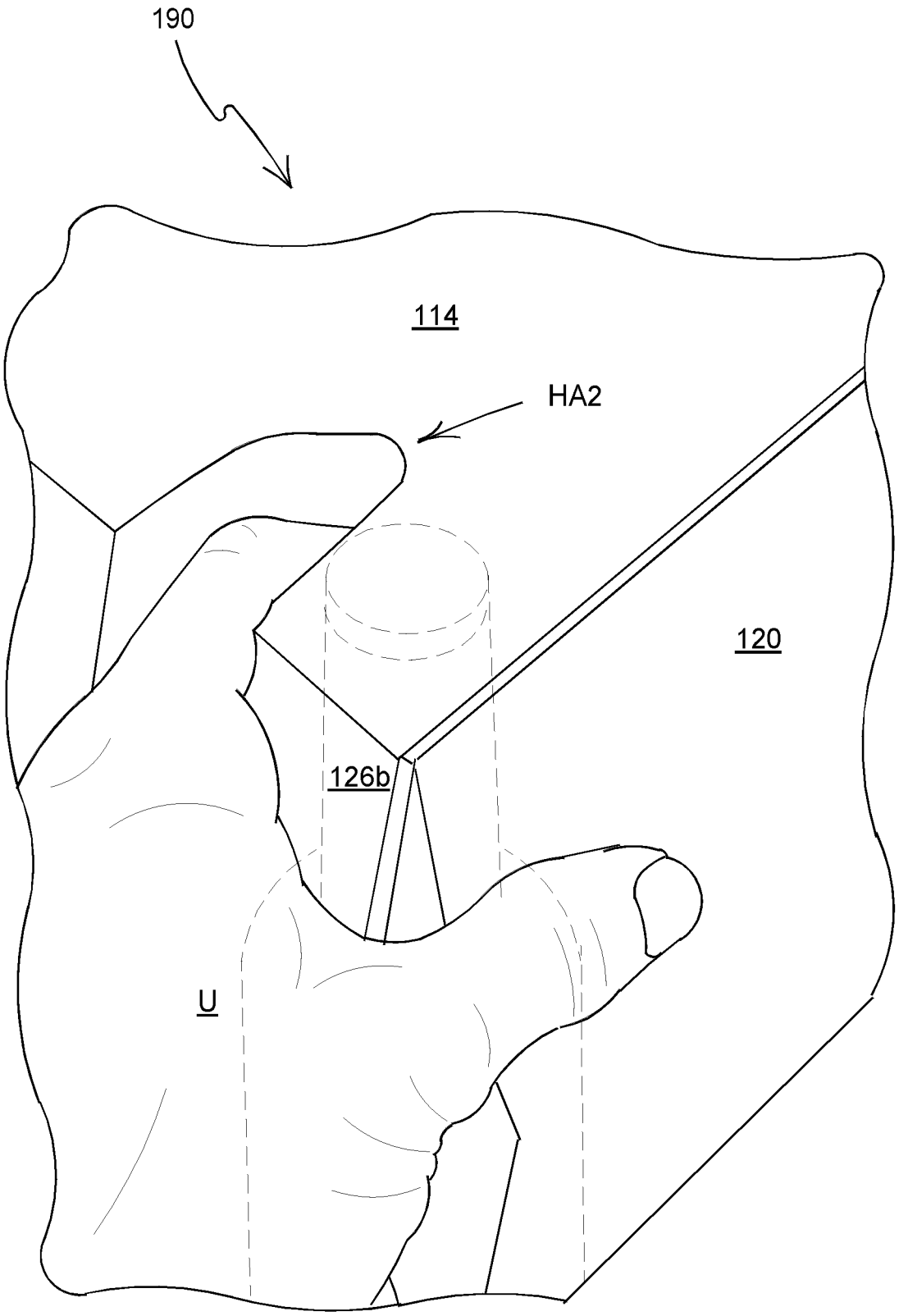
FIG. 5 is a perspective view from above of a portion of a carton formed from the blank of FIG. 4 showing the carrying handle in use.

FIG. 4 illustrates a blank 110 for forming carton 190 as shown in FIG. 5 according to a second illustrated embodiment.

The blank 110 comprises a plurality of main panels 112, 114, 116, 118, 120 hingedly connected one to the next in a linear series. A top panel 114 is hingedly connected to a first side panel 116 by a fold line 115. The first side panel 116 is hingedly connected to a base panel 118 by a fold line 117. The base panel 118 is hingedly connected to a second side panel 120 by a fold line 119. The blank 110 comprises a glue panel 112 hingedly connected to top panel 114 by a fold line 113.

The plurality of main panels 112, 114, 116, 118, 120 of the blank 110 form an open ended tubular structure in a set-up condition.

Each of the ends of the tubular structure is at least partially closed by end closure panels. In the illustrated embodiment the ends of the tubular structure are fully closed by end closure panels 126*a*, 128*a*, 130*a*, 132*a*, 134*a*, 126*b*, 128*b*, 130*b*, 132*b*, 134*b*.

End closure panels 126*a*, 128*a*, 130*a*, 132*a*, 134*a* are configured to close a first end of the tubular structure and end panels 126*b*, 128*b*, 130*b*, 132*b*, 134*b* are configured to close a second end of the tubular structure.

A first end closure panel 126*a* is hingedly connected to a first end of top panel 114 by a fold line 127*a*. A second end closure panel 128*a* is hingedly connected to a first end of first side panel 116 by a pair of fold lines 129*a*, 129*b*. A third end closure panel 130*a* is hingedly connected to a first end of base panel 118 by a fold line 131*a*. A fourth end closure panel 132*a* is hingedly connected to a first end of the second side panel 120 by a pair of fold lines 133*a*, 133*b*. The pair of fold lines 129*a*, 129*b* define first corner panel 116*a* disposed between the first side panel and the second end closure panel 128*a*. The pair of fold lines 133*a*, 133*b* define second corner panel 120*a* disposed between the second side panel and the fourth end closure panel 132*a*. A fifth end closure panel 134*a* is hingedly connected to a first end of glue panel 112 by a fold line 135*a*.

A sixth end closure panel 126*b* is hingedly connected to a second end of top panel 114 by a fold line 127*b*. A seventh end closure panel 128*b* is hingedly connected to a second end of the first side panel 116 by a pair of fold lines 129*c*, 129*d*. An eighth end closure panel 130*b* is hingedly connected to a second end of base panel 118 by a fold line 131*b*. A ninth end closure panel 132*b* is hingedly connected to a second end of second side panel 120 by a pair of fold lines 133*c*, 133*d* which define a fourth corner panel 120*b* connecting between the second side panel 120 and the ninth end closure panel 132*b*. A tenth end closure panel 134*b* is hingedly connected to a second end of glue panel 112 by a fold line 135*b*.

The pair of fold lines 129*c*, 129*d* define third corner panel 116*b* disposed between the first side panel and the seventh end closure panel 128*b*. The pair of fold lines 133*c*, 133*d* define fourth corner panel 120*b* disposed between the second side panel and the ninth end closure panel 132*b*.

The blank 110 comprises a first handle structure HA1 struck in part from the first end closure panel 126*a* and in part from the top panel 114.

The first handle structure HA1 comprises a first aperture 140*a* struck from the top panel 114 and a tab 144*a* struck from the first end closure panel 126*a*. The tab 144*a* is substantially elongate in shape. The tab 144*a* is hingedly connected to the first end closure panel 126*a* by a first fold line 142*a*. The tab 144*a* comprises a second fold line 143*a* which extends transversely across the tab 144*a* from the first fold line 142*a*, defining a first side edge, to an opposing second side edge thereof. The second fold line 143*a* defines in part a lower portion of the tab 144*a*. The tab 144*a* comprises a third fold line 141*a* which extends longitudinally from the second fold line 143*a* to an upper edge of the tab 144*a*. The upper edge of the tab 144*a* is defined by the first aperture 140*a* and is substantially collinear with the fold line 127*a* hinging the first end closure panel 126*a* to the top panel 114.

The blank 110 comprises a second handle structure HA2 struck in part from the sixth end closure panel 126*b* and in part from the top panel 114.

The second handle structure HA2 comprises a second aperture 140*b* struck from the top panel 114 and a tab 144*b* struck from the sixth end closure panel 126*b*. The tab 144*b* is substantially elongate in shape. The tab 144*b* is hingedly connected to the sixth end closure panel 126*b* by a first fold line 142*b*. The tab 144*b* comprises a second fold line 143*b* which extends transversely across the tab 144*b* from the first fold line 142*b*, defining a first side edge, to an opposing second side edge thereof. The second fold line 143*b* defines in part a lower portion of the tab 144*b*. The tab 144*b* comprises a third fold line 141*b* which extends longitudinally from the second fold line 143*b* to an upper edge of the tab 144*b*. The upper edge of the tab 144*b* is defined by the second aperture 140*b* and is substantially collinear with the fold line 127*b* hinging the sixth end closure panel 126*b* to the top panel 114.

The blank 110 comprises a first recess R1 struck from the fourth end closure panel 132*a*. The first recess R1 is substantially elongate in shape and is struck from an upper edge of the fourth end closure panel 132*a*. The first recess R1 is configured such that when the blank 110 is in an assembled state the first recess R1 and the first handle structure HA1 are disposed in an overlying relationship. The first recess R1 is shaped and dimensioned such that the tab 144*a* can pass through the fourth end closure panel 132*a* when folded internally of the carton 190.

The blank 110 comprises a second recess R2 struck from the ninth end closure panel 132*b*. The second recess R2 is substantially elongate in shape and is struck from an upper edge of the ninth end closure panel 132*b*. The second recess R2 is configured such that when the blank 110 is in an assembled state the second recess R2 and the second handle structure HA2 are disposed in an overlying relationship. The second recess R1 is shaped and dimensioned such that the tab 144*b* can pass through the ninth end closure panel 132*b* when folded internally of the carton 190.

FIG. 5 illustrates a user employing the second handle structure HA2 in the carton 190. The aperture struck from the top panel 114 facilitates access for the user to the carrying handle and disposed the edge of the top panel 114 away from the user hand such that the user is less likely to make contact with an edge of the material from which the carton 190 is formed.

The handle structure HA2 forms a handle opening when the tab 144*b* is folded internally of the carton 190. Preferably, the handle opening (and the tab 144*b*) is placed at a position generally aligned with a space or void disposed between an article disposed in the corner of the carton 190 and the adjacent article. In the illustrated embodiment in which the array or matrix of articles is greater than 2×2, then each handle opening may be located closer to the carton top than to the carton bottom and to one side of the carton 190 than to the other opposing side of the carton 190. Preferably, each handle opening is oriented such that the longitudinal axis of each handle opening extends along, if not parallel to, the cylindrical axis of the adjacent corner article.

In the second embodiment of FIGS. 4 and 5 the first and second thumb tabs 46*a*, 46*b* shown in the first embodiment of FIGS. 1 to 3 have been omitted, in alternative embodiments the blank 110 may include first and second thumb tabs 46*a*, 46*b* arranged such that a user may engage the first or second handle structure HA1, HA2 along with a respective thumb tab.

The second fold lines 143*a*, 143*b* allow lower portions of the tabs 144*a*, 144*b* respectively to be folded over a shoulder portion of a corner article such that the tab 144*a* may deform about a shoulder of the corner article. In this way the upper portion of tab 144*a* can be readily brought to bear against a neck portion of the corner article.

Figure 6:
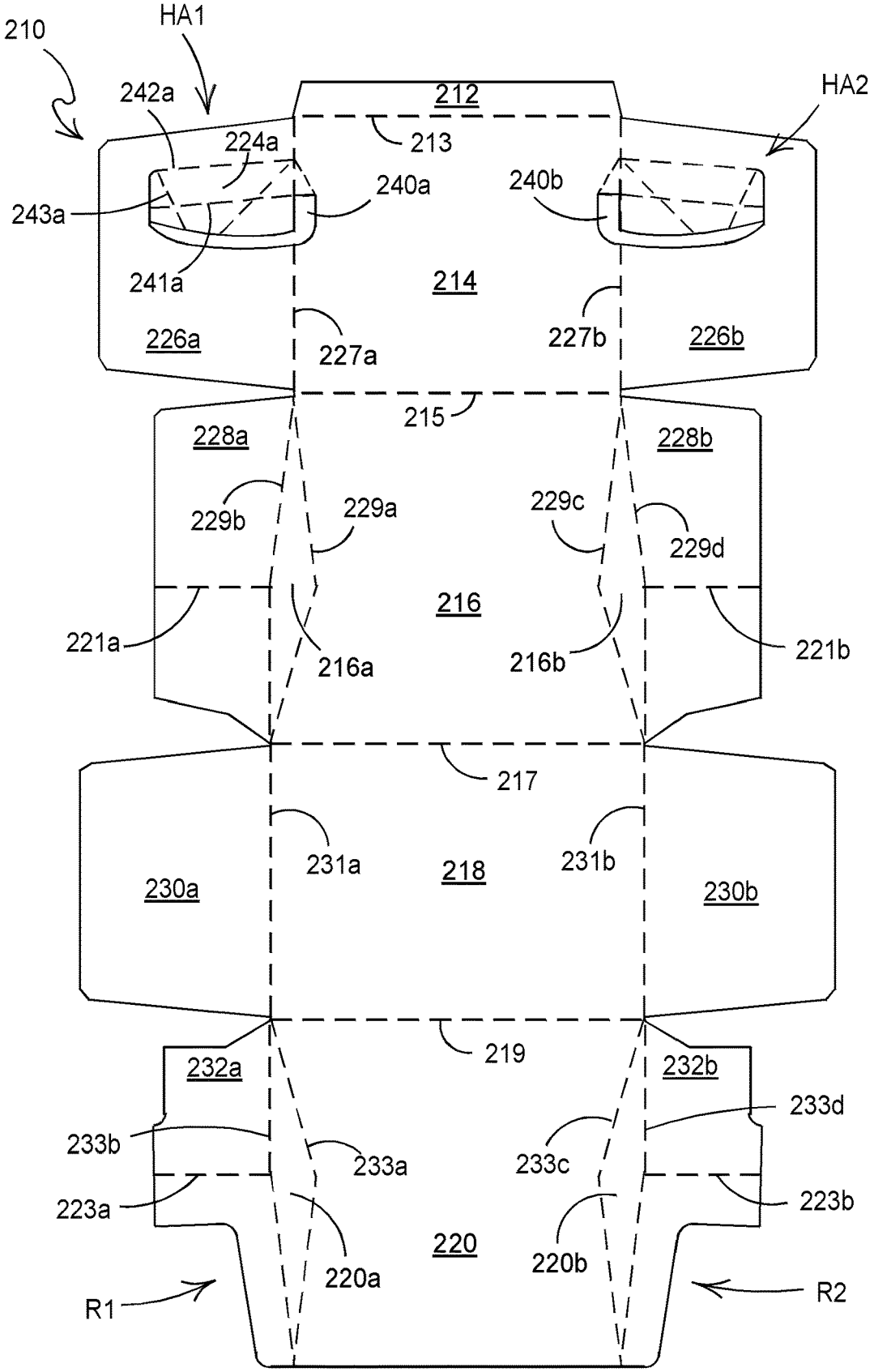
FIG. 6 is a plan view from above of a blank for forming a carton according to a third embodiment.

FIG. 6 illustrates a blank 210 for forming carton 290, as shown in FIGS. 7 to 12, according to a third illustrated embodiment.

The blank 210 comprises a plurality of main panels 212, 214, 216, 218, 220 hingedly connected one to the next in a linear series. The blank 210 comprises a glue panel 212 hingedly connected to a top panel 214 by a fold line 213. The top panel 214 is hingedly connected to a first side panel 216 by a fold line 215. The first side panel 216 is hingedly connected to a base panel 218 by a fold line 217. The base panel 218 is hingedly connected to a second side panel 220 by a fold line 219.

The plurality of main panels 212, 214, 216, 218, 220 of the blank 210 form an open ended tubular structure in a set-up condition.

Each of the ends of the tubular structure is at least partially closed by end closure panels. In the illustrated embodiment the ends of the tubular structure are fully closed by end closure panels 226*a*, 228*a*, 230*a*, 232*a*, 226*b*, 228*b*, 230*b*, 232*b*.

End closure panels 226*a*, 228*a*, 230*a*, 232*a*, are configured to close a first end of the tubular structure and end panels 226*b*, 228*b*, 230*b*, 232*b* are configured to close a second end of the tubular structure.

The blank 210 comprises a first handle structure HA1 struck in part from a first end closure panel 226*a* and in part from the top panel 214. The blank 210 comprises a second handle structure HA2 struck in part from a sixth end closure panel 226*b* and in part from the top panel 214. The second handle structure HA2 is substantially similar in construction to the first handle structure HA1 and the first and second handle structures HA1, HA2 will be described by reference to the first handle structure HA1.

Figure 7:
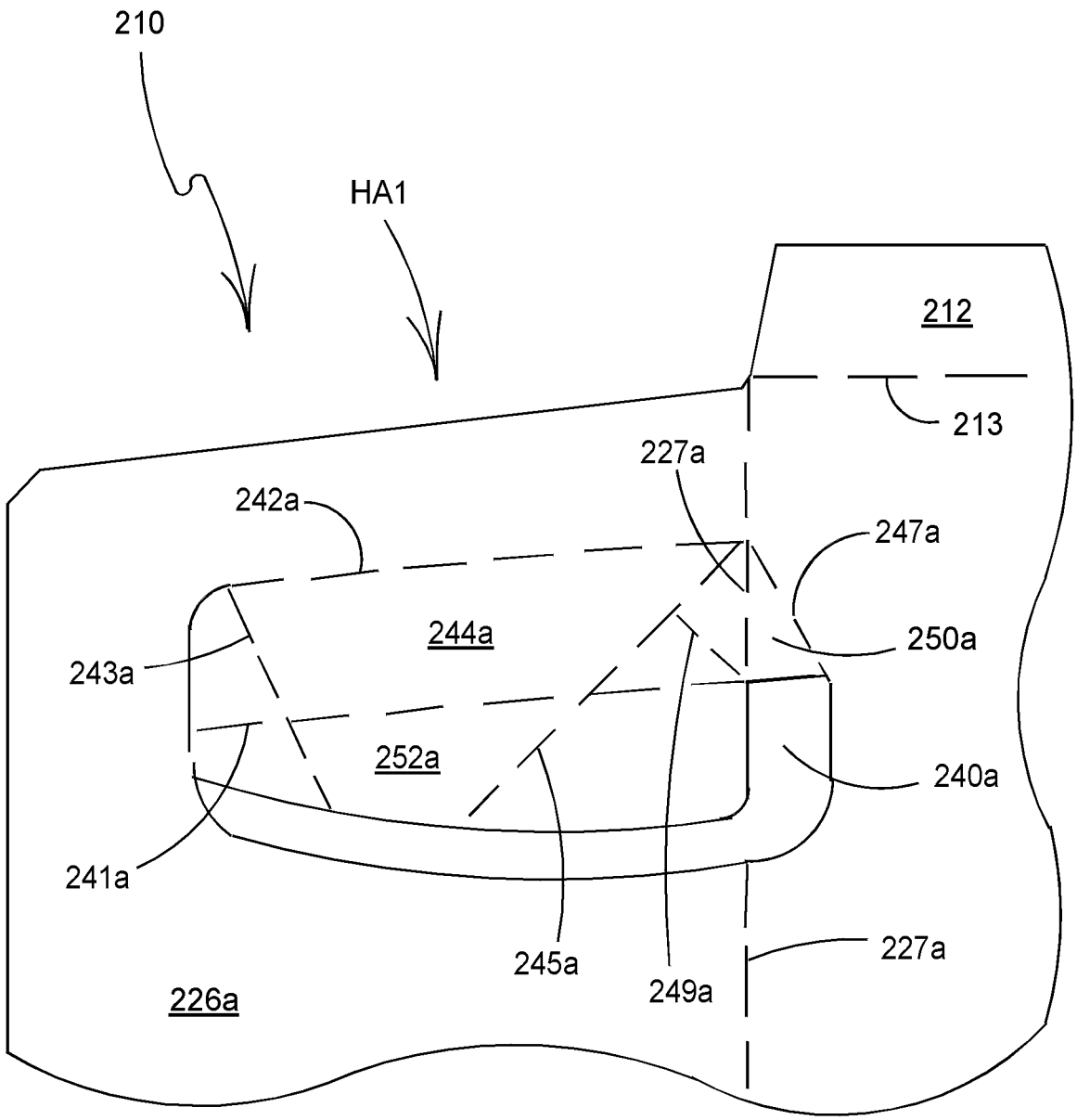
FIG. 7 is an enlarged plan view of a portion of a the blank of FIG. 6.

FIG. 7 shows an enlarged plan view of the blank 210 and illustrates in detail the first handle structure HA1. The first handle structure HA1 comprises a first aperture 240*a* in part from a first end closure panel 226*a* and in part from the top panel 214. The first handle structure HA1 comprises a tab 244*a* struck from the first end closure panel 226*a*. The tab 244*a* is substantially elongate in shape. The tab 244*a* is hingedly connected to the first end closure panel 226*a* by a first fold line 242*a*. The tab 244*a* comprises a second fold line 241*a* which extends longitudinally across the tab 244*a* from an upper edge to a lower edge. The second fold line 241*a* is substantially parallel to the first fold line 242*a* and defines in part an outer portion 252*a* of the tab 244*a*. The tab 244*a* comprises a third fold line 243*a* which extends across the tab 244*a* from a first side edge defined by the first fold line 242*a* to a second opposing side edge defined by the first aperture 240*a*. The third fold line 243*a* defines in part a lower portion of the tab 244*a*. The upper edge of the tab 244*a* is defined in part by the first aperture 240*a* and in part by a fold line 227*a*. A web panel 250*a* is hingedly connected to the upper edge of the tab 244*a* along fold line 227*a*. The web panel 250*a* is hingedly connected to the top panel 214 by a fourth fold line 247*a*. The fourth fold line 247*a* is arranged convergent with respect to the fold line 227*a*. The fourth fold line 247*a* intersects or meets with the fold line 227*a* at a first end and intersects or meets with the first fold line 242*a* at the first end. The web panel 250*a* is triangular in shape and is defined in part by the fold line 227*a*, in part by fourth fold line 247*a* and in part by the first aperture 240*a*.

The tab 244*a* comprises a fifth fold line 245*a* which extends from a first side edge defined by the first fold line 242*a* to a second opposing side edge defined by the first aperture 240*a*. The fifth fold line 245*a* extends from a vertex defined by the fourth fold line 247*a*, the fold line 227*a* and the first fold line 242*a*.

The tab 244*a* comprises a sixth fold line 249*a* which extends from the fifth fold line 245*a* to a vertex defined by the fold line 227*a* and the second fold line 241*a*.

The third fold line 243*a* and the fifth fold line 245*a* are arranged convergently with respect to each other and converge towards the second edge of the tab 244*a* defined by the first aperture 240*a*.

The blank 210 comprises a first recess R1 struck from a fourth end closure panel 232*a*. The first recess R1 is struck from an upper edge and a side edge of the fourth end closure panel 232*a* so as to remove a corner portion of the fourth end closure panel 232*a*. The first recess R1 is configured such that when the blank 210 is in an assembled state the first recess R1 and the first handle structure HA1 are disposed in an overlying relationship. The first recess R1 is shaped and dimensioned such that the tab 244*a* can pass through the fourth end closure panel 232*a* when folded internally of the carton 290.

The blank 210 comprises a second recess R2 struck from the eighth end closure panel 232*b*. The second recess R2 is struck from an upper edge and a side edge of the eighth end closure panel 232*b* so as to remove a corner portion of the eighth end closure panel 232*b*. The second recess R2 is configured such that when the blank 210 is in an assembled state the second recess R2 and the second handle structure HA2 are disposed in an overlying relationship. The second recess R1 is shaped and dimensioned such that the tab 244*b* can pass through the eighth end closure panel 232*b* when folded internally of the carton 290.

Figure 8:
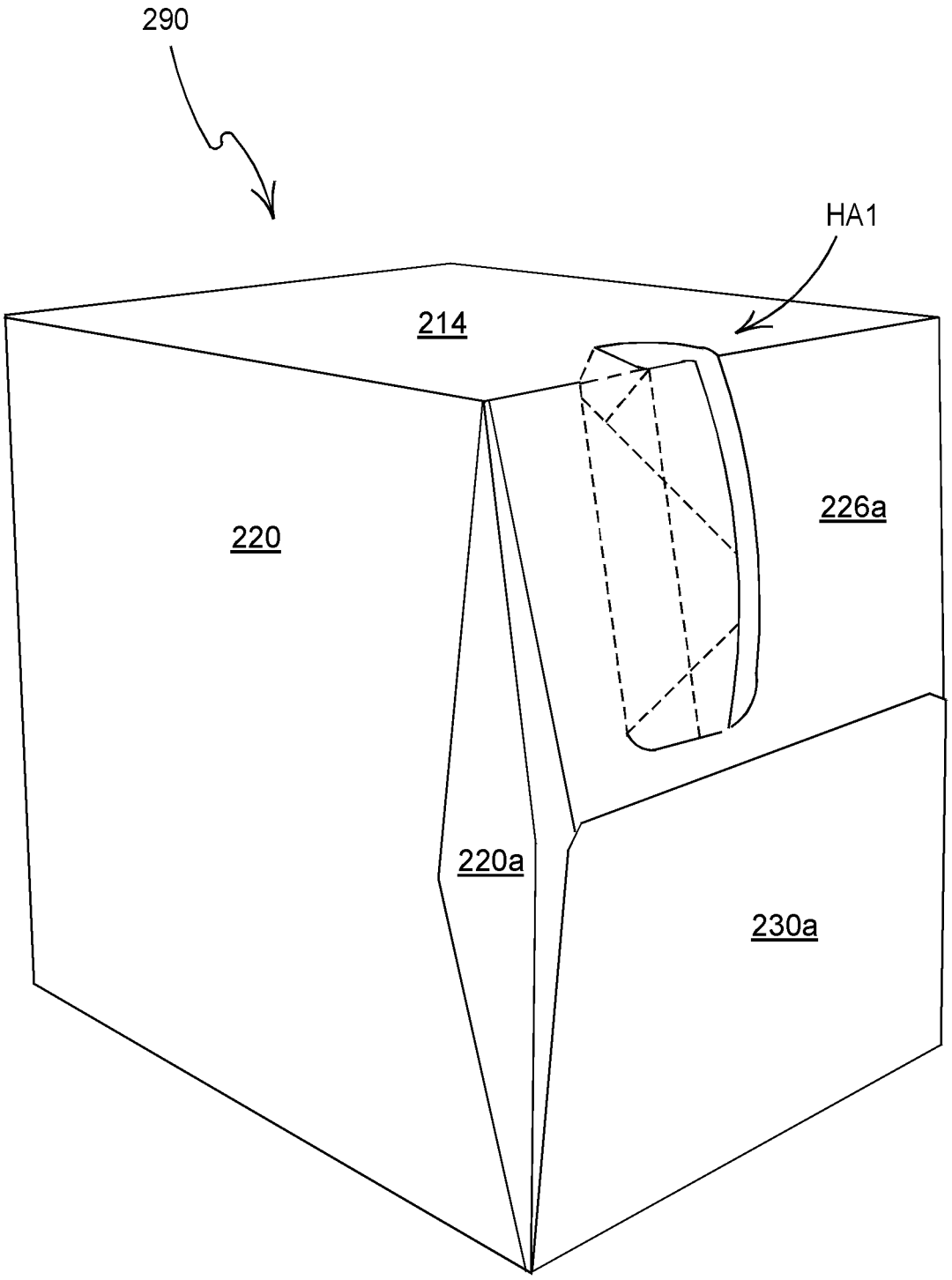
FIG. 8 is a perspective view from above of a carton formed from the blank of FIG. 6.
Figure 9:
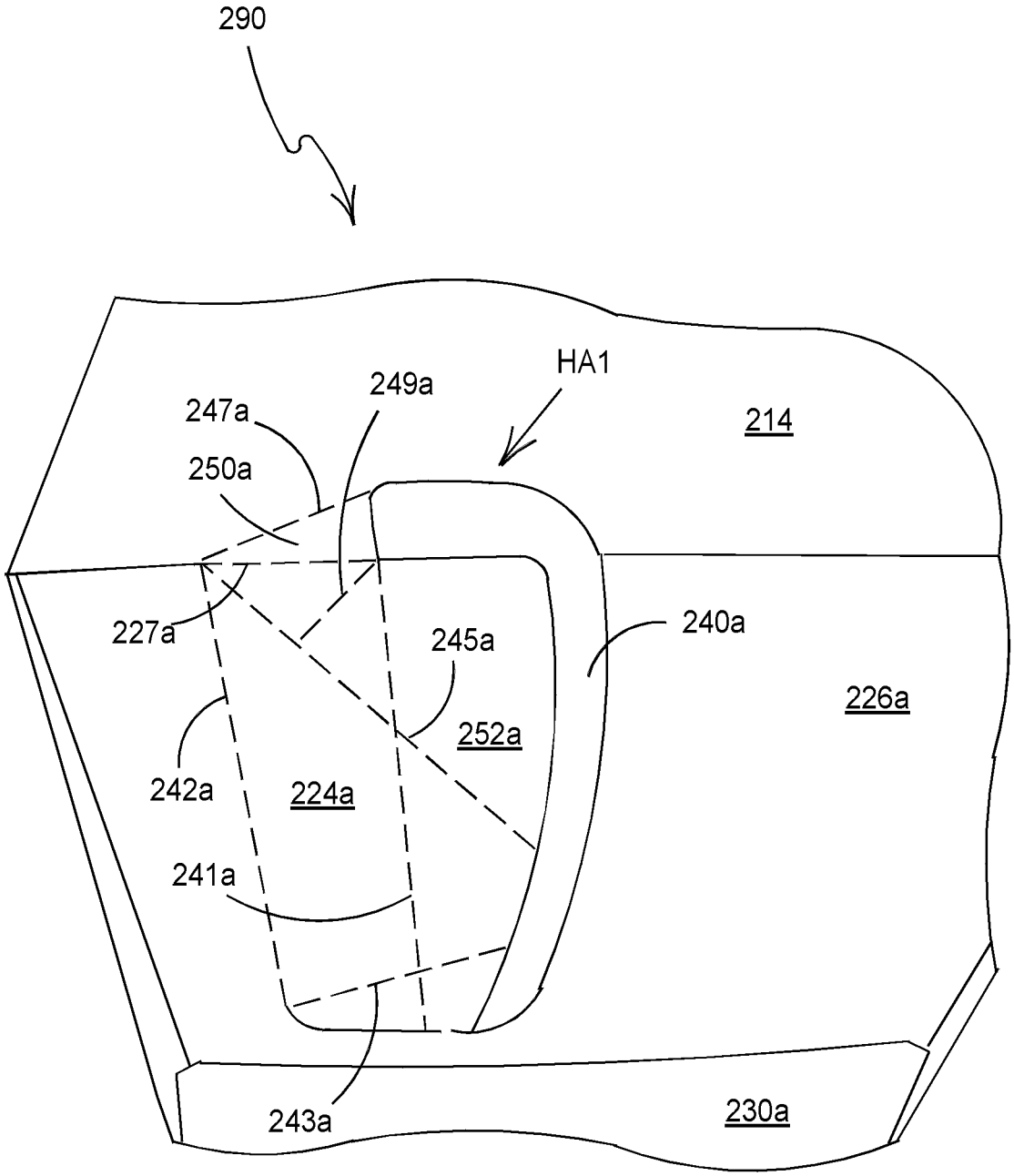
FIG. 9 is an enlarged perspective view from above of a portion of the carton formed from the blank of FIG. 6.

FIGS. 8 and 9 illustrate a carton 290 formed from the blank 210, the carton to be formed by a series of sequential folding operations in a straight line machine in a manner substantially the same as that described above in relation to the embodiment of FIGS. 1 to 3.

Figure 10:
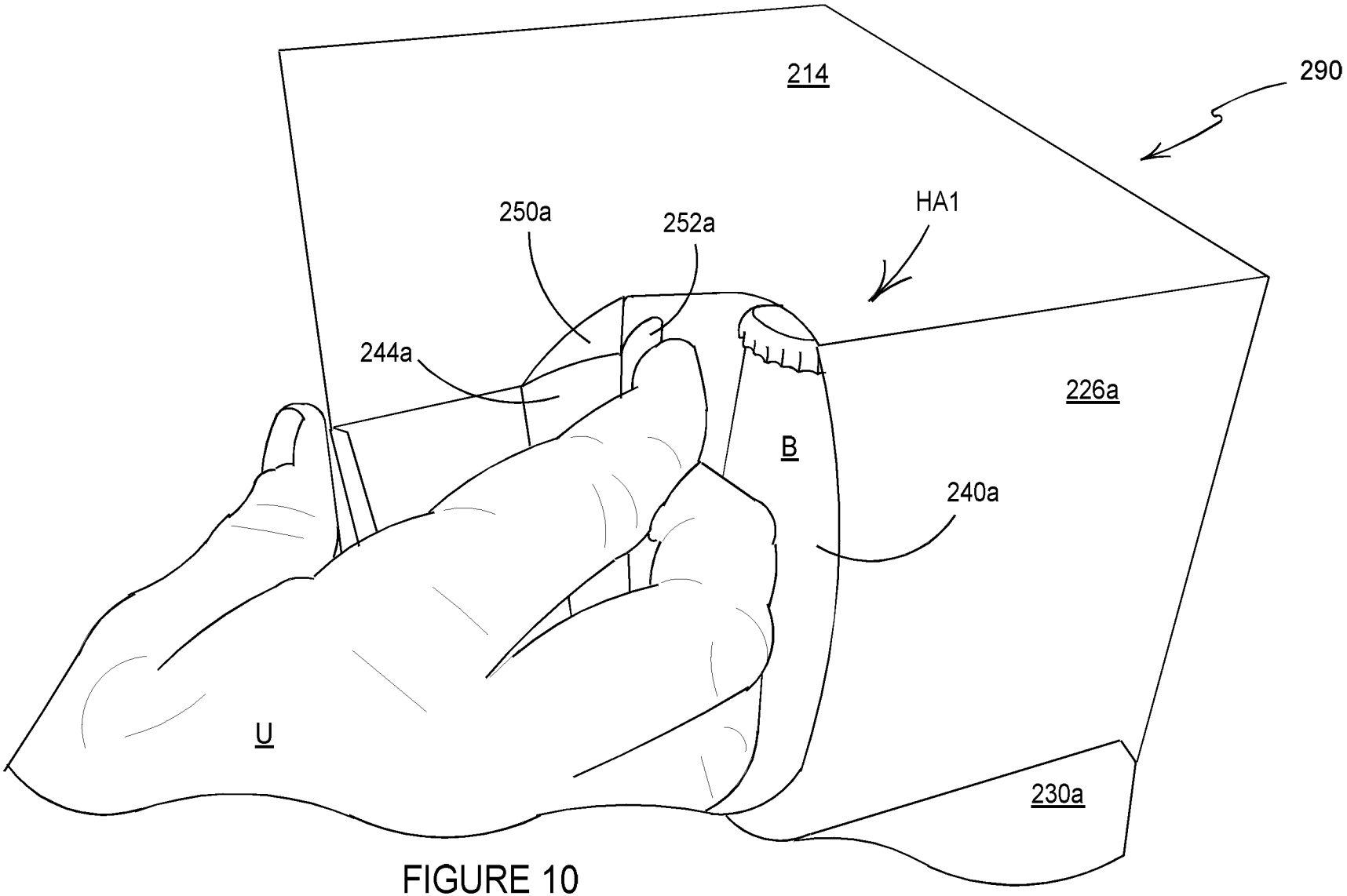
FIG. 10 is a perspective view from above of a carton formed from the blank of FIG. 6 showing a carrying handle in stage of deployment.

FIG. 10 illustrates the carton 290 in which the first handle structure HA1 is in a stage of deployment. A user U folds the tab 244*a* about the first fold line 242*a* and outer portion 252*a* of the tab 244*a* about the second fold line 241*a*. In doing so the tab 244*a* is displaced inwardly of the carton 290; the tab 244*a* is wrapped or folded, at least in part, about an article B disposed in the corner of the carton 290.

The handle structure HA1 forms a handle opening when the tab 244*a* is folded internally of the carton 290. Preferably, the handle opening (and the tab 244*a*) is placed at a position generally aligned with a space or void disposed between an article disposed in the corner of the carton 290 and the adjacent article. In the illustrated embodiment in which the array or matrix of articles is greater than 2×2, then each handle opening may be located closer to the carton top than to the carton bottom and to one side of the carton 190 than to the other opposing side of the carton 290. Preferably, each handle opening is oriented such that the longitudinal axis of each handle opening extends along, if not parallel to, the cylindrical axis of the adjacent corner article.

Figure 11:
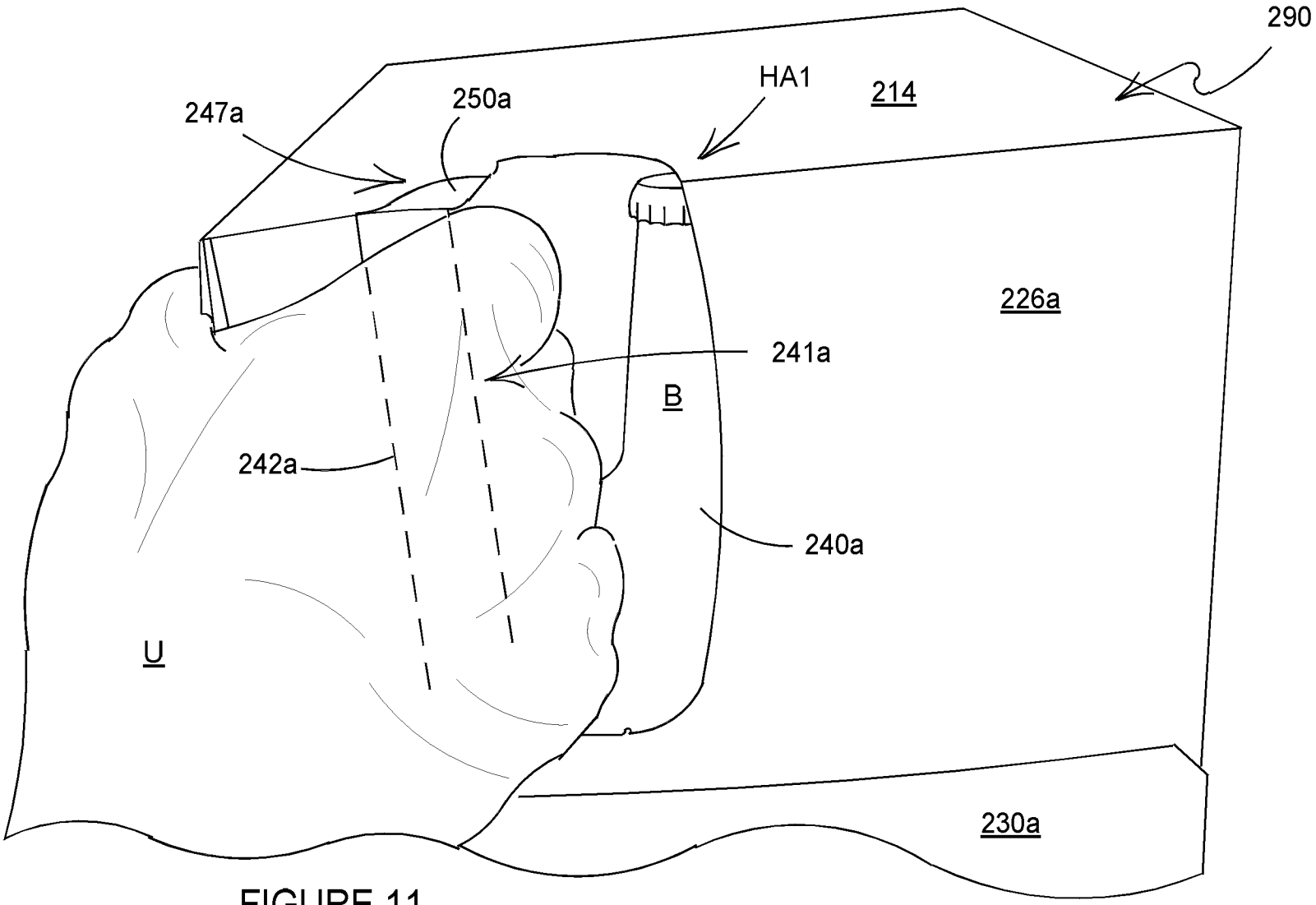
FIG. 11 is a perspective view from above of a carton formed from the blank of FIG. 6 showing a carrying handle in use.

The user can then employ the first handle structure HA1 as a carrying handle as shown in FIG. 11. The user places a thumb against the second side panel 220 and inserts their fingers into the carton 290 through the opening formed by the first aperture 240*a* and the displacement of the tab 244*a*. The web panel 250*a* is folded about fold line 247*a* out of the plane of the top panel 214 to be disposed internally of the walls of the carton 290. The web panel 250*a* is folded about the fold line 227*a* with respect to the tab 244*a*. The user wraps their hand and/or fingers about the first fold line 242*a* and the second fold line 241*a*. The user wraps their hand and/or fingers about the tab 244*a* and outer portion 252*a* of the tab 244*a*. The first fold line 242*a* and the second fold line 241*a* are shown in phantom (dashed) lines in FIG. 11. The tab 244*a* forms an ergonomic comfortable carrying handle in combination with the corner article B. The web panel 250*a* restricts the range of movement of the upper portion of the tab 244*a* internally of the carton 290. The proximity of the user's hand to the upper end portion of the corner article is limited. This reduces the likelihood of the user grasping the closure device of the article. Additionally or alternatively the web panel 250*a* shields the users hand from the closure device of the article.

Figure 12:
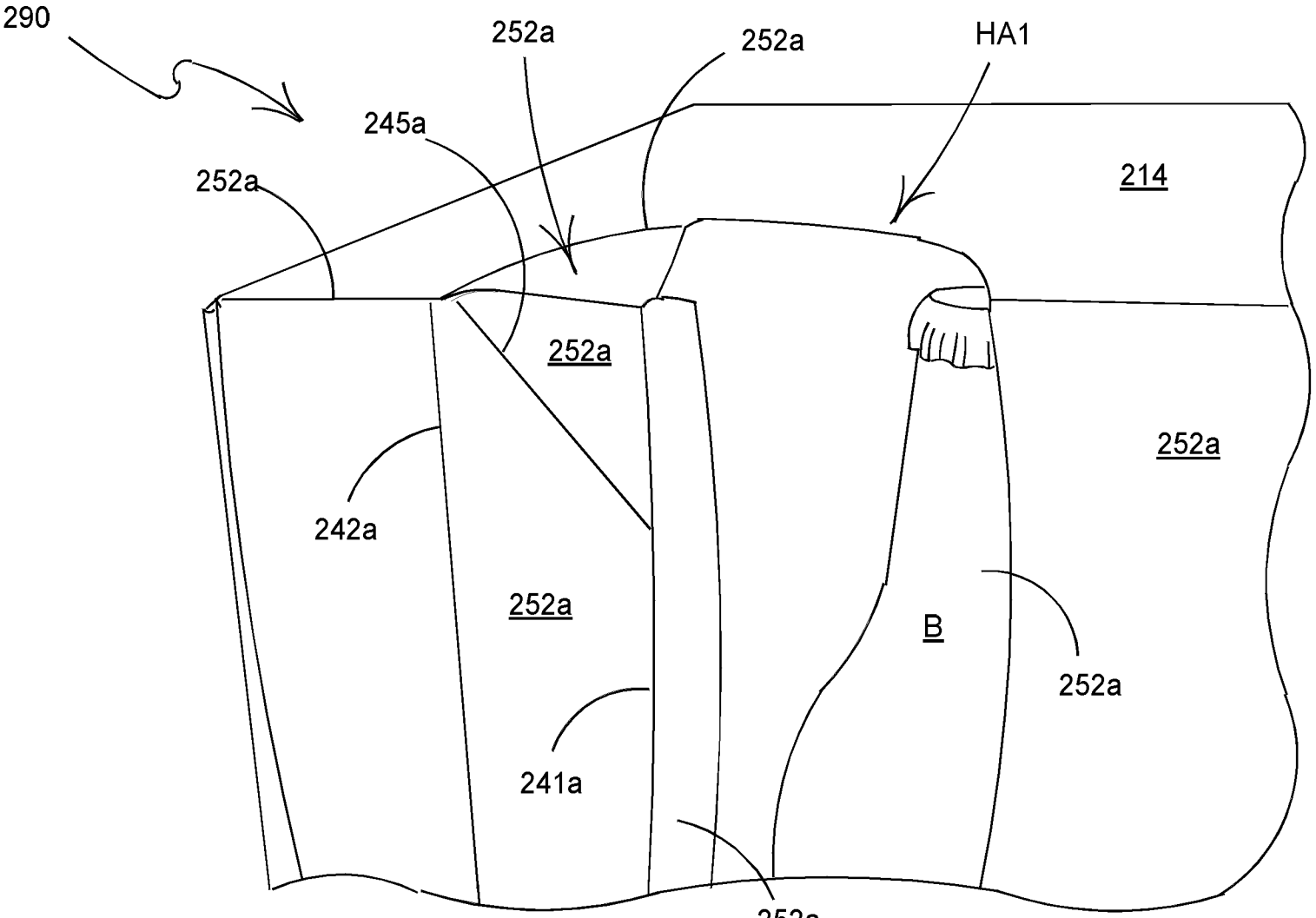
FIG. 12 is a perspective view from above of a carton formed from the blank of FIG. 6 showing a carrying handle in operative condition.

FIG. 12 shows the first handle structure HA1 in an operative condition. The first handle structure HA1 once first deployed remains in a deployed condition for subsequent reuse by a consumer.

The second fold line 243*a* allows a lower portion of the tab 244*a* respectively to be folded over a shoulder portion of a corner article such that the tab 244*a* may deform about a shoulder of the corner article. In this way the upper portion of tab 244*a* can be readily brought to bear against a neck portion of the corner article.

Figure 13:
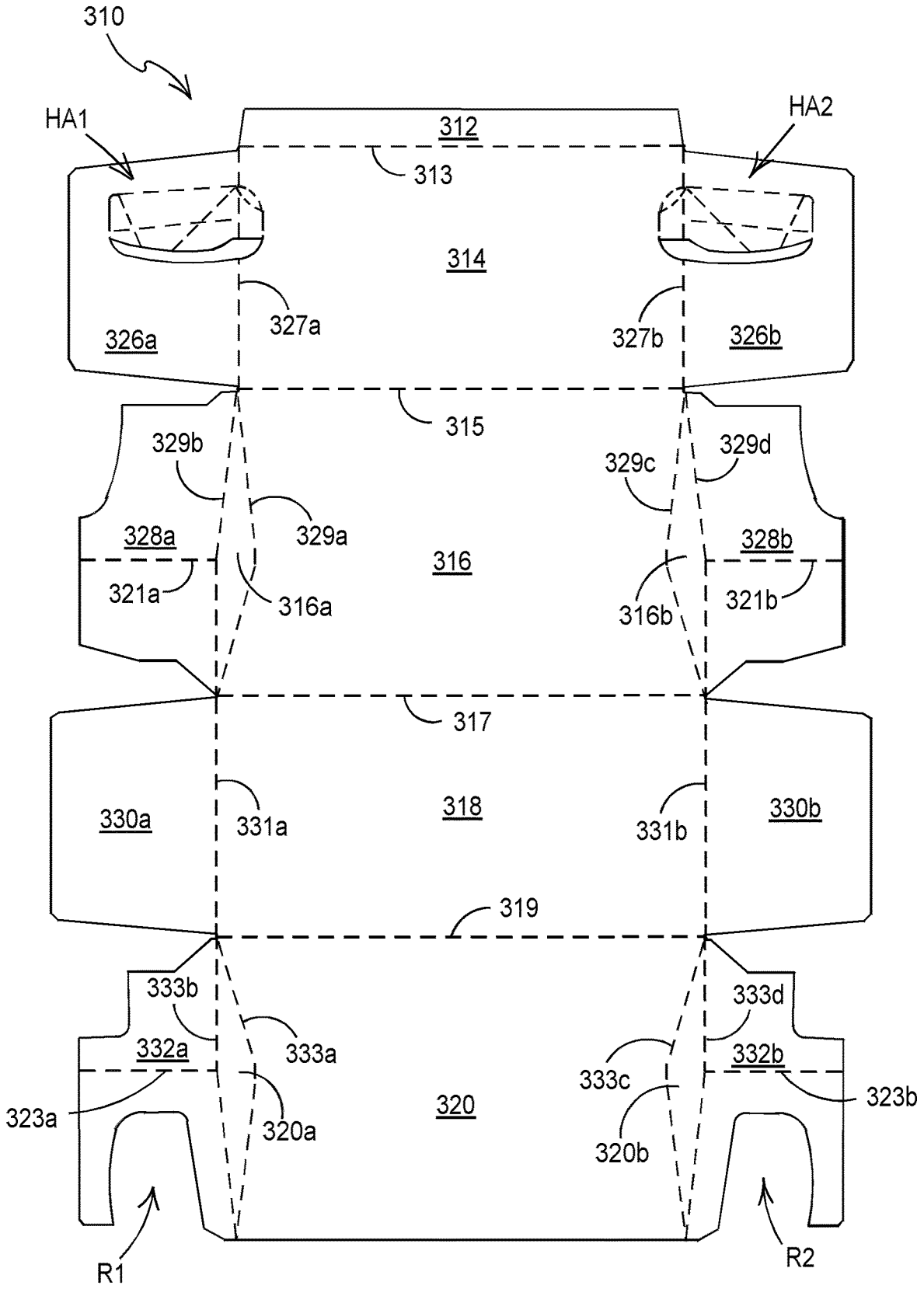
FIG. 13 is a plan view from above of a blank for forming a carton according to a fourth embodiment.
Figure 14:
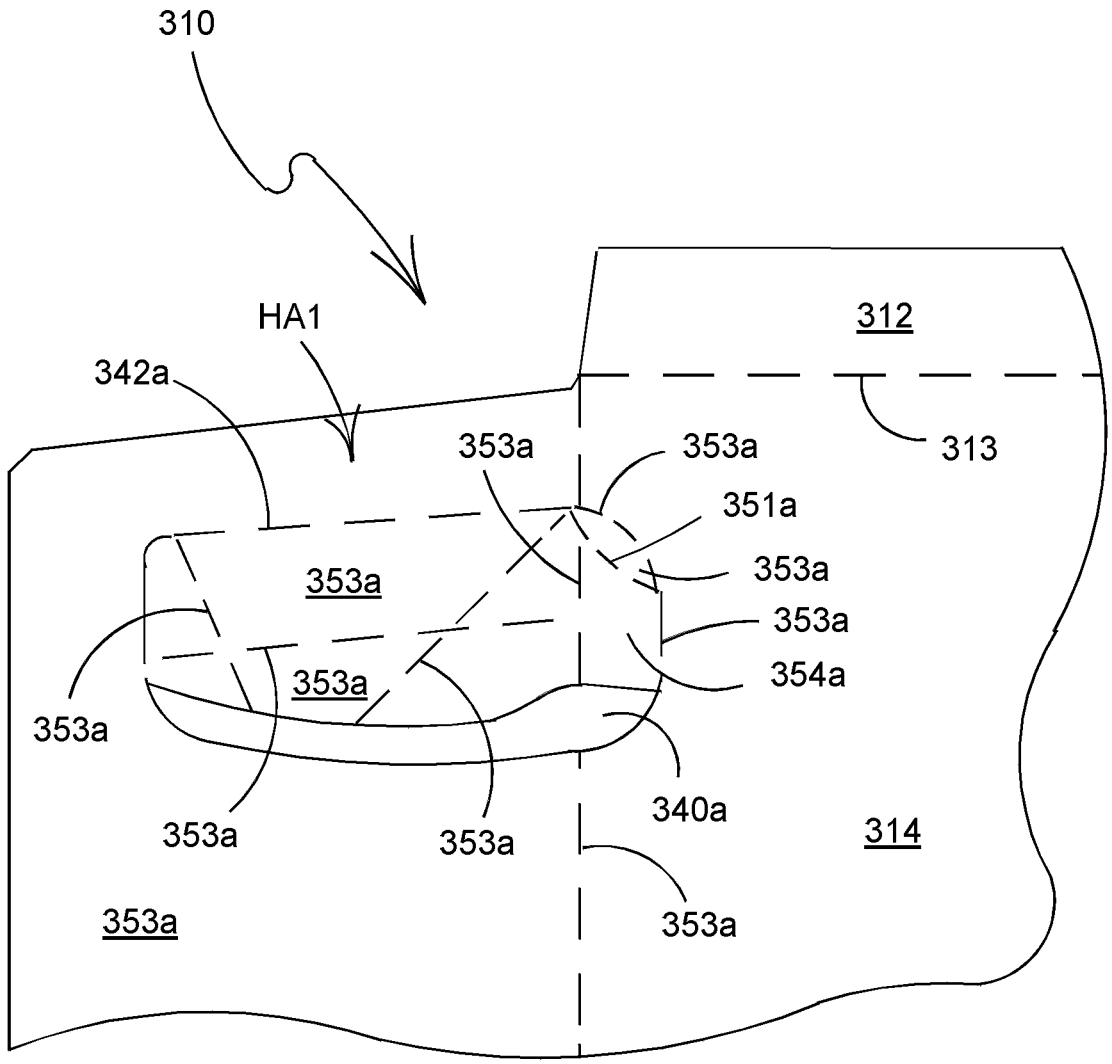
FIG. 14 is an enlarged plan view of a portion of a the blank of FIG. 13.
Figure 15:
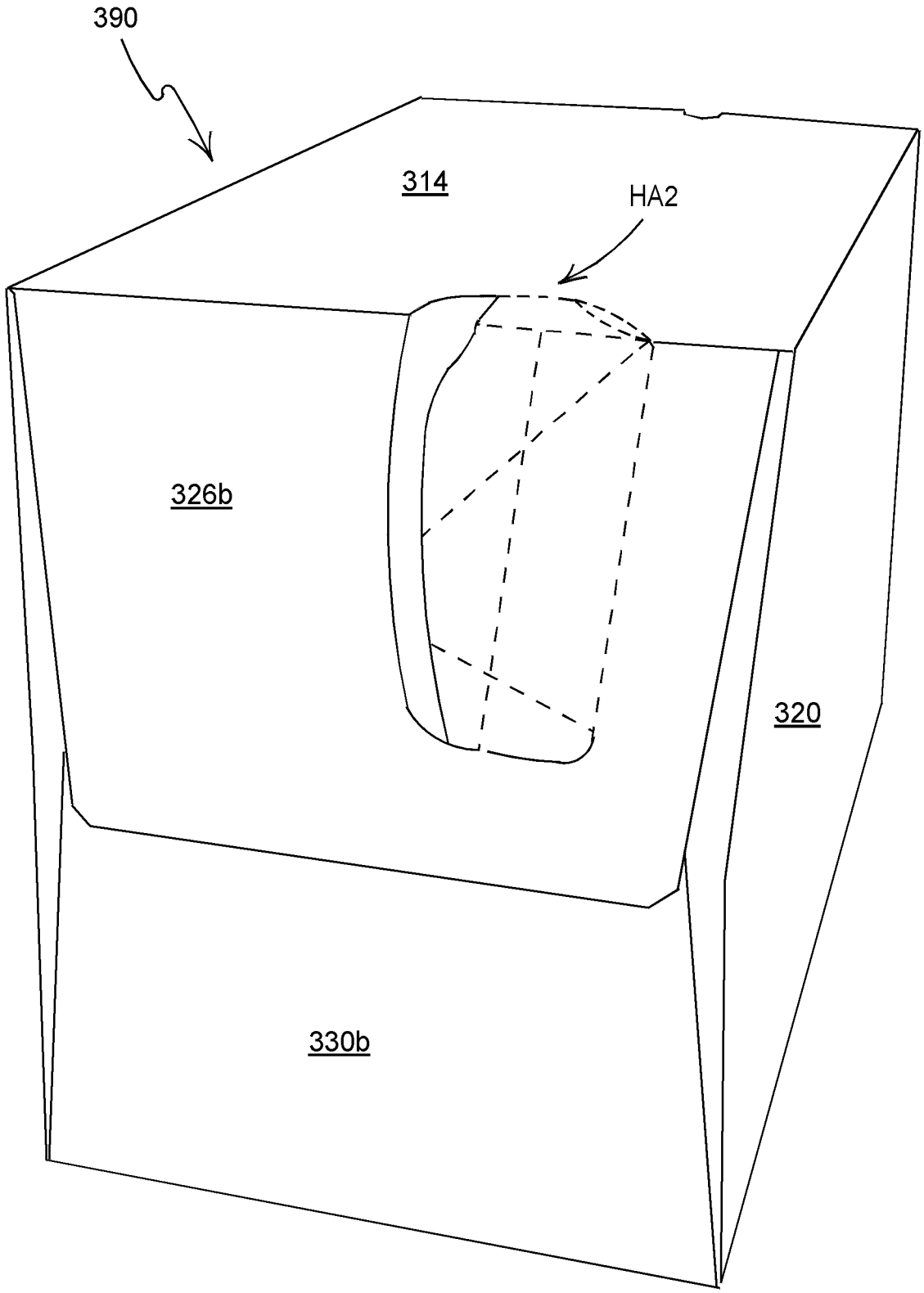
FIG. 15 is a perspective view from above of a carton formed from the blank of FIG. 13.
Figure 16:
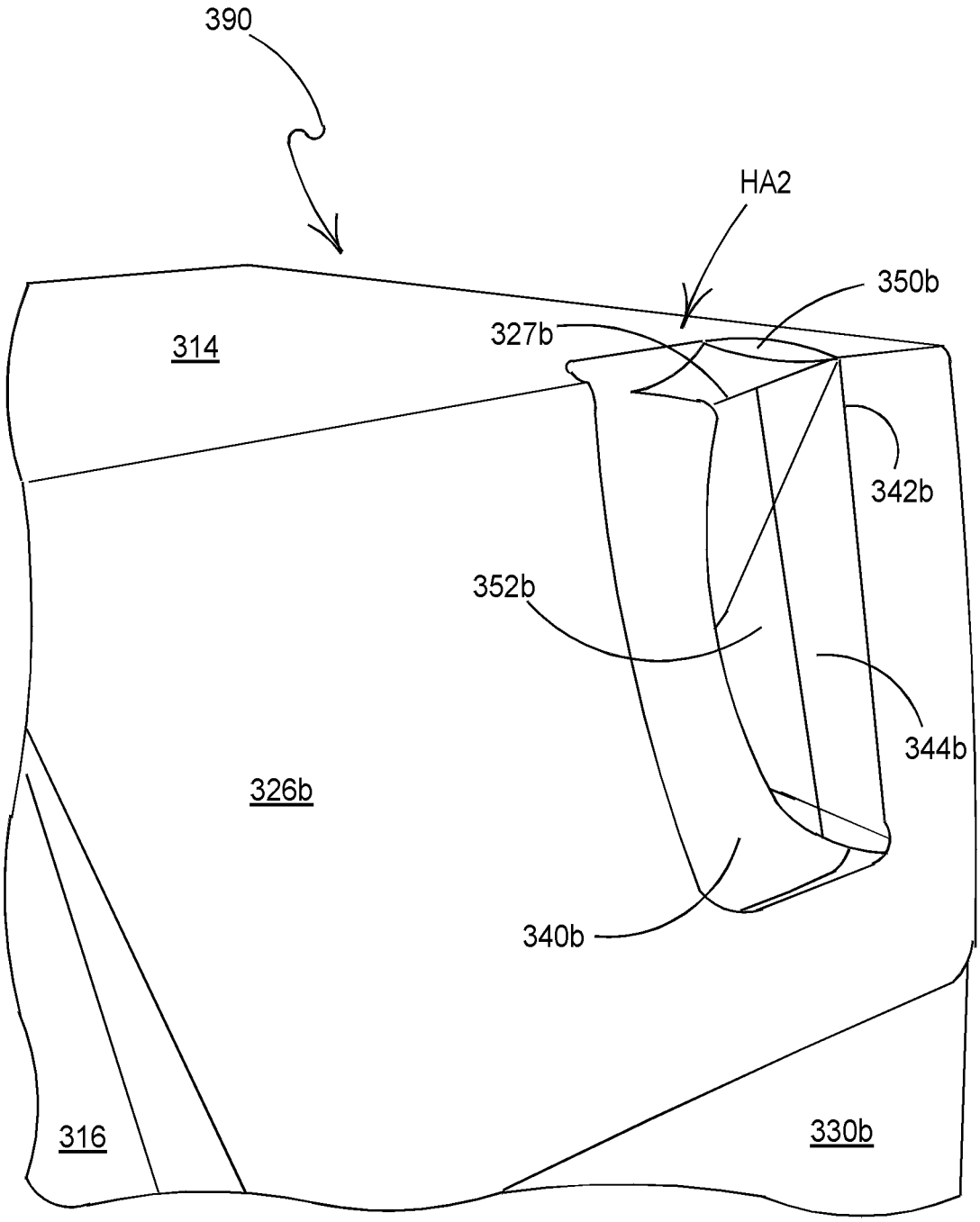
FIG. 16 is a perspective from above of a carton formed from the blank of FIG. 13 showing a carrying handle in an operative condition.

FIGS. 13 and 14 illustrate a blank 310 for forming carton 390, as shown in FIGS. 15 and 16, according to a fourth illustrated embodiment.

The blank 310 comprises a plurality of main panels 312, 314, 316, 318, 320 hingedly connected one to the next in a linear series. The blank 310 comprises a glue panel 312 hingedly connected to a top panel 314 by a fold line 313. The top panel 314 is hingedly connected to a first side panel 316 by a fold line 315. The first side panel 316 is hingedly connected to a base panel 318 by a fold line 317. The base panel 318 is hingedly connected to a second side panel 320 by a fold line 319.

The plurality of main panels 312, 314, 316, 318, 320 of the blank 310 form an open ended tubular structure in a set-up condition.

Each of the ends of the tubular structure is at least partially closed by end closure panels. In the illustrated embodiment the ends of the tubular structure are fully closed by end closure panels 326*a*, 328*a*, 330*a*, 332*a*, 326*b*, 328*b*, 330*b*, 332*b*.

End closure panels 326*a*, 328*a*, 330*a*, 332*a* are configured to close a first end of the tubular structure and end panels 326*b*, 328*b*, 330*b*, 332*b* are configured to close a second end of the tubular structure.

The blank 310 comprises a first handle structure HA1 struck in part from a first end closure panel 326*a* and in part from the top panel 314. The blank 310 comprises a second handle structure HA2 struck in part from a sixth end closure panel 326*b* and in part from the top panel 314. The second handle structure HA2 is substantially the similar in construction to the first handle structure HA1 and the first and second handle structures HA1, HA2 will be described by reference to the first handle structure HA1.

FIG. 14 shows an enlarged plan view of the blank 310 and illustrates in detail the first handle structure HA1. The first handle structure HA1 comprises a first aperture 340*a* in part from a first end closure panel 326*a* and in part from the top panel 314. The first handle structure HA1 comprises a tab 344*a* struck from the first end closure panel 326*a*. The tab 344*a* is substantially elongate in shape. The tab 344*a* is hingedly connected to the first end closure panel 326*a* by a first fold line 342*a*. The tab 344*a* comprises a second fold line 341*a* which extends longitudinally across the tab 344*a* from an upper edge to a lower edge. The second fold line 341*a* is substantially parallel to the first fold line 342*a* and defines in part an outer portion 352*a* of the tab 344*a*. The tab 344*a* comprises a third fold line 343*a* which extends across the tab 344*a* from a first side edge defined by the first fold line 342*a* to a second opposing side edge defined by the first aperture 340*a*. The third fold line 343*a* defines in part a lower portion of the tab 344*a*.

A web panel 350*a* is hingedly connected to the top panel 314 by a fourth fold line 347*a*. The fourth fold line 347*a* is arranged convergent with respect to the fold line 327*a*. The fourth fold line 347*a* intersects or meets with the fold line 327*a* at a first end and intersects or meets with the first fold line 342*a* at the first end. The web panel 350*a* is football-shaped and is defined in part by the fourth fold line 347*a* and in part by an opposing fifth fold line 351*a*.

An extension panel 354*a* is hingedly connected to the upper edge of the tab 344*a* along a fold line 327*a*. The extension panel 354*a* is hingedly connected to the web panel 350*a* along a first side edge by the fifth fold line 351*a*. A second side edge of the extension panel 354*a* is defined by the portion of the first aperture 340*a* struck from the top panel 314. The extension panel 354*a* is severably connected to the top panel along an upper edge thereof by a severance line 353*a*.

The fourth fold line 347*a* is arcuate in shape. The fifth fold line 351*a* is arcuate in shape. A first end of the fourth fold line 347*a* and a first end of the fifth fold line 351*a* intersect or meet to form a first vertex. A second end of the fourth fold line 347*a* and a second end of the fifth fold line 351*a* intersect or meet to form a second vertex. In this way the web panel 350*a* is substantially elliptical in shape, the ellipse comprising a major axis or transverse diameter and a minor axis or conjugate diameter, wherein the web panel 350*a* comprises pointed ends at each end of the major axis.

The tab 344*a* comprises a sixth fold line 345*a* which extends from a first side edge defined by the first fold line 342*a* to a second opposing side edge defined by the first aperture 340*a*. The sixth fold line 345*a* extends from a vertex defined by the fourth fold line 347*a*, the fold line 327*a* and the first fold line 342*a*.

The third fold line 343*a* and the sixth fold line 345*a* are arranged convergently with respect to each other and converge towards the second edge of the tab 344*a* defined by the first aperture 340*a*.

The blank 310 comprises a first recess R1 struck from a fourth end closure panel 332*a*. The first recess R1 is struck from an upper edge of the fourth end closure panel 332*a*. The first recess R1 is configured such that when the blank 310 is in an assembled state the first recess R1 and the first handle structure HA1 are disposed in an overlying relationship. The first recess R1 is shaped and dimensioned such that the tab 344*a* can pass through the fourth end closure panel 332*a* when folded internally of the carton 390.

The blank 310 comprises a second recess R2 struck from the eighth end closure panel 332*b*. The second recess R2 is struck from an upper edge of the eighth end closure panel 332*b* so as to remove a corner portion of the eighth end closure panel 332*b*. The second recess R2 is configured such that when the blank 310 is in and assembled state the second recess R2 and the second handle structure HA2 are disposed in an overlying relationship.

The second recess R1 is shaped and dimensioned such that the tab 344*b* can pass through the eighth end closure panel 332*b* when folded internally of the carton 390.

FIGS. 15 and 16 illustrate a carton 390 formed from the blank 310, the carton to be formed by a series of sequential folding operations in a straight line machine in a manner substantially the same as that described above in relation to the embodiment of FIGS. 1 to 3.

FIG. 16 shows the second handle structure HA2 in an operative condition. The second handle structure HA2 once first deployed remains in a deployed condition for subsequent reuse by a consumer. A user U has folded the tab 344*b* about the first fold line 342*b* and outer portion 352*b* of the tab 344*b* about the second fold line 341*a*. In doing so the tab 344*b* has been displaced inwardly of the carton 390; the tab 344*b* is wrapped or folded, at least in part, about an article B disposed in the corner of the carton 390.

The handle structure HA2 forms a handle opening when the tab 344*b* is folded internally of the carton 390. Preferably, the handle opening (and the tab 344*b*) is placed at a position generally aligned with a space or void disposed between an article disposed in the corner of the carton 390 and the adjacent article. In the illustrated embodiment in which the array or matrix of articles is greater than 2×2, then each handle opening may be located closer to the carton top than to the carton bottom and to one side of the carton 390 than to the other opposing side of the carton 390. Preferably, each handle opening is oriented such that the longitudinal axis of each handle opening extends along, if not parallel to, the cylindrical axis of the adjacent corner article.

A user can employ the second handle structure HA2 as a carrying handle by placing a thumb against the second side panel 320 and inserting their fingers into the carton 390 through the opening formed by the first aperture 340*b* and the displacement of the tab 344*b*. The web panel 350*b* has been folded about fold line 347*b* out of the plane of the top panel 314 to be disposed internally of the walls of the carton 390. The web panel 350*b* has been folded about the fold line 327*b* with respect to the tab 344*b*. A user may wrap their hand and/or fingers about the first fold line 342*b* and the second fold line 341*b*. The user may wrap their hand and/or fingers about the tab 344*b* and outer portion 352*b* of the tab 344*b*. The tab 344*b* forms an ergonomic comfortable carrying handle in combination with the corner article B. The web panel 350*b* restricts the range of movement of the upper portion of the tab 344*b* internally of the carton 390. The proximity with which a user may place their hand to the upper end portion of the corner article is thereby limited. This reduces the likelihood of the user grasping the closure device of the article. Additionally or alternatively the web panel 350*b* shields the users hand from the closure device of the article.

The third fold line 343*b* allows a lower portion of the tab 344*b* respectively to be folded over a shoulder portion of a corner article such that the tab 344*b* may deform about a shoulder of the corner article. In this way the upper portion of tab 344*b* can be readily brought to bear against a neck portion of the corner article.

The tab 344*b* may be in frictional engagement with the corner article which frictional engagement facilitates retention of the tab 344*b* in the folded, operative condition.

It can be appreciated that various changes may be made within the scope of the present invention. For example, the size and shape of the panels and apertures may be adjusted to accommodate articles of differing size or shape. The glue panel may take the form of a second top panel disposed outermost, the top panel being secured to an inner face of the second top panel.

Figure 17:
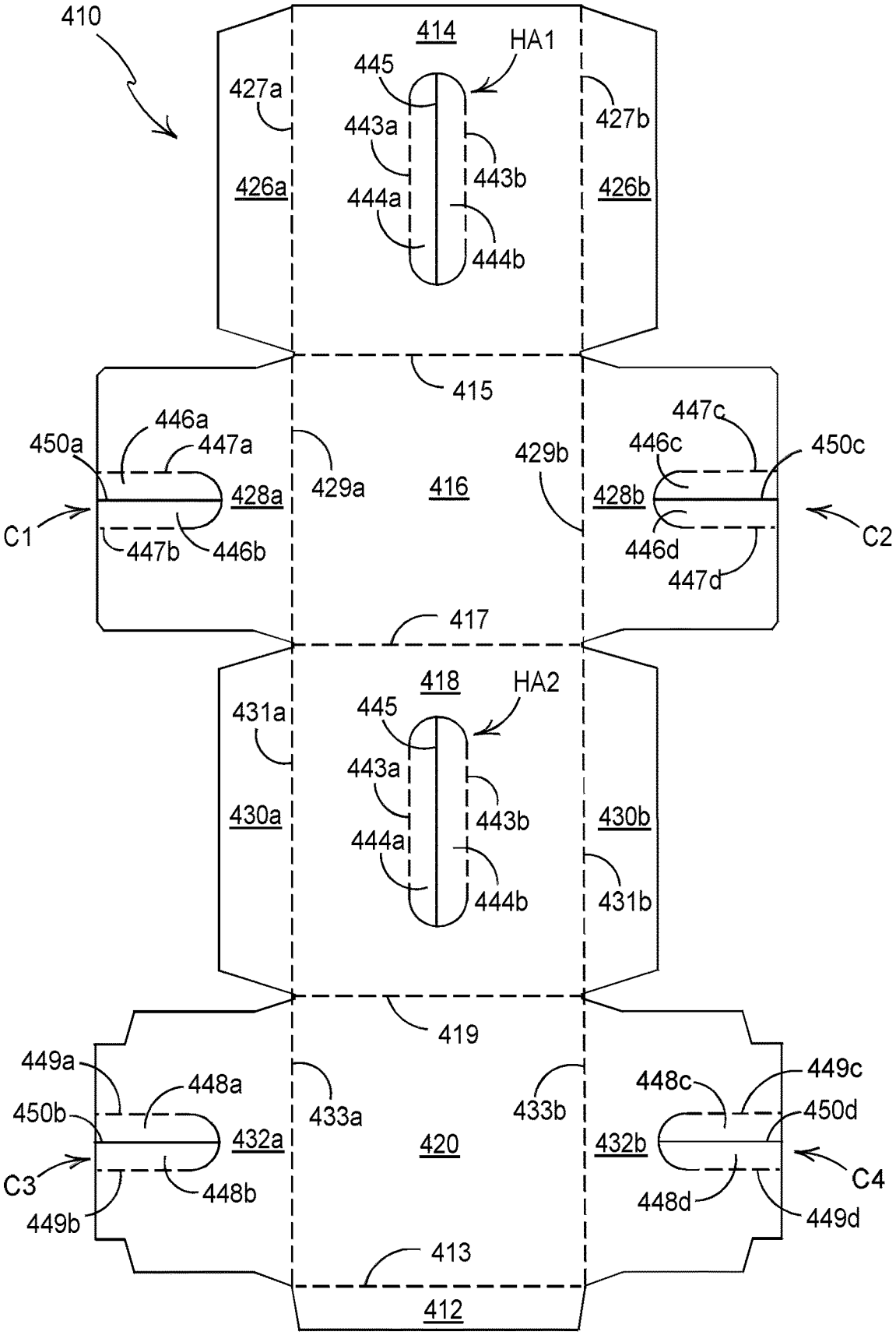
FIG. 17 is a plan view from above of a blank for forming a carton according to a fifth embodiment.
Figure 18:
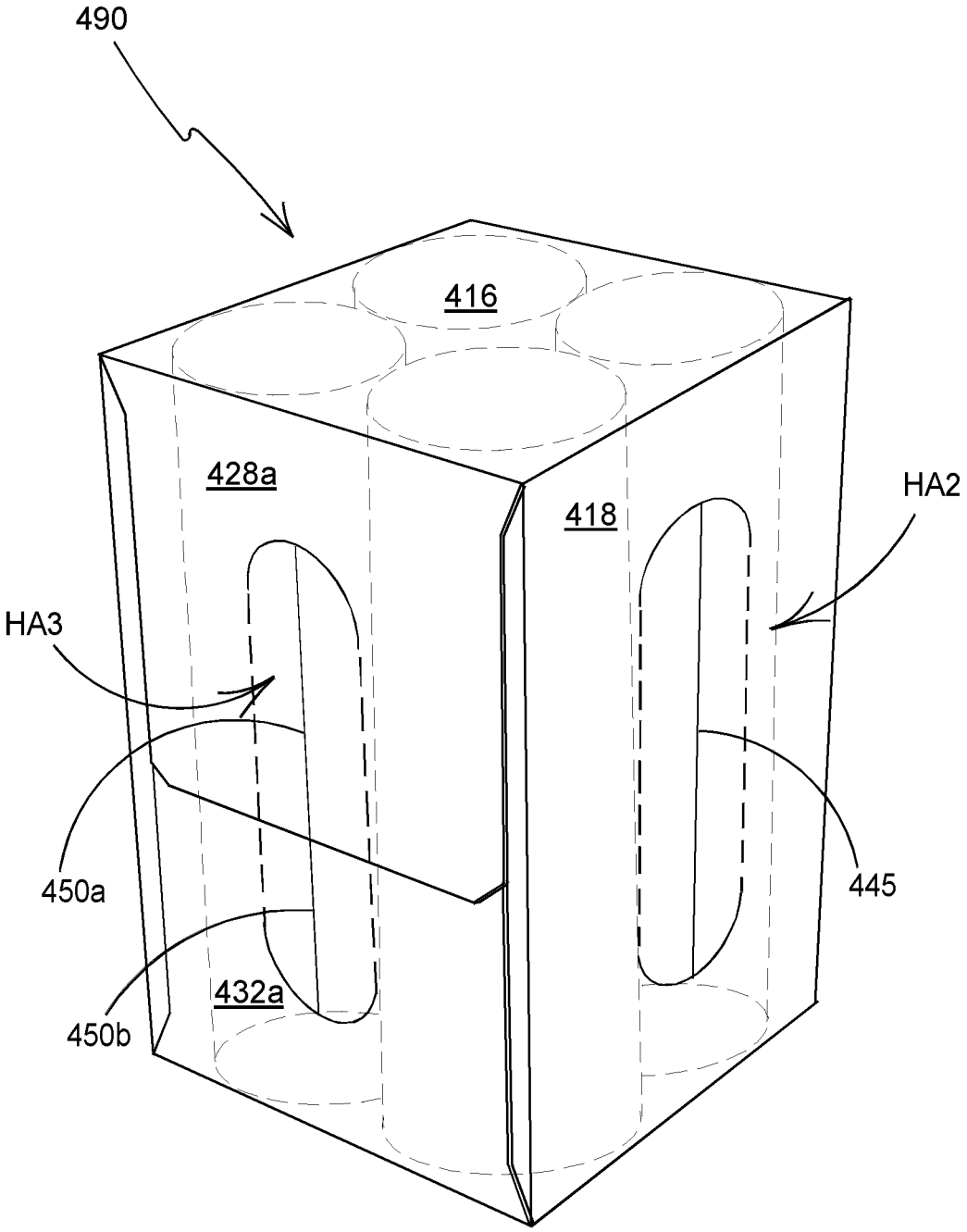
FIG. 18 is a perspective view from above of a carton formed from the blank of FIG. 17.
Figure 19:
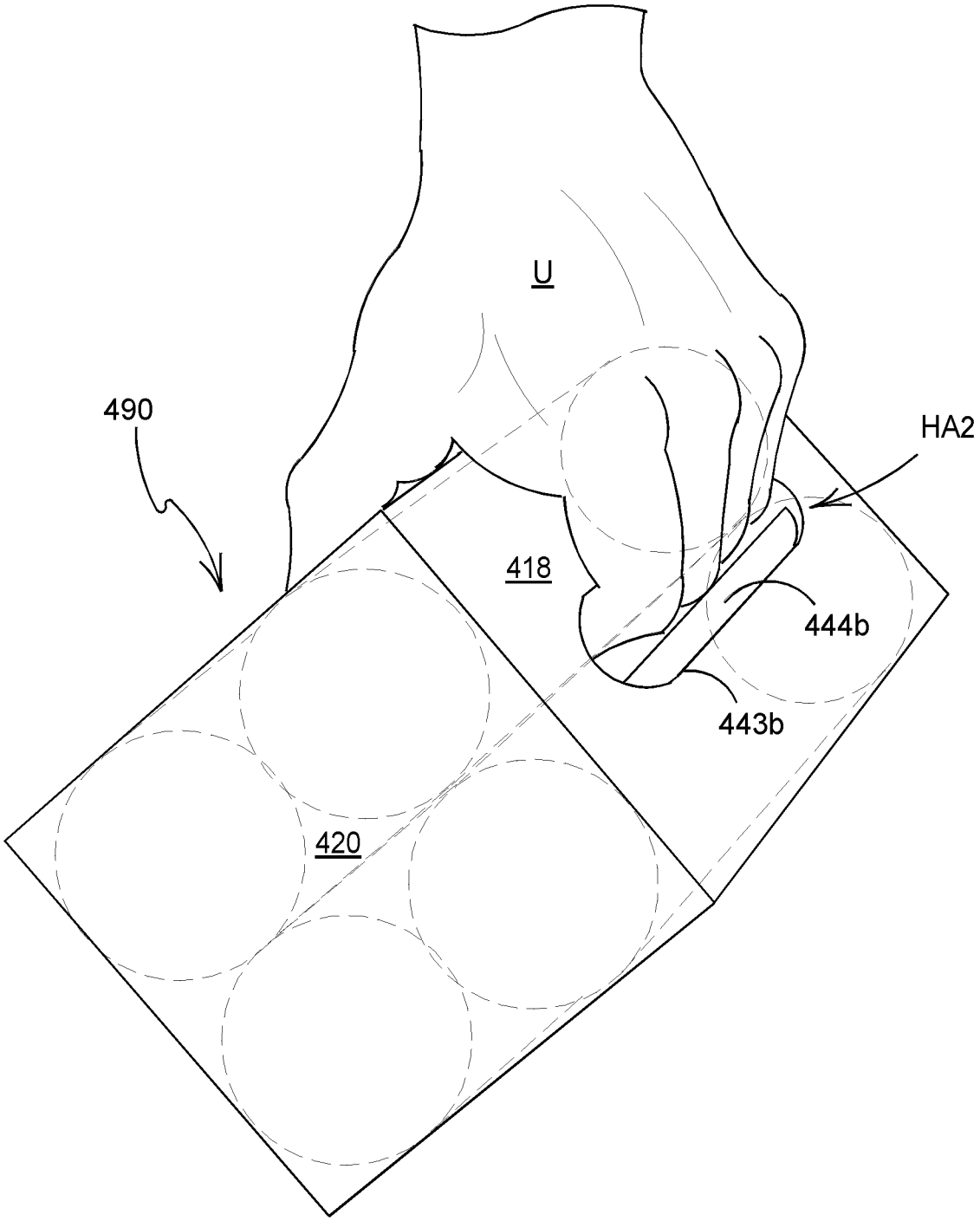
FIG. 19 is a perspective view from above of a carton formed from the blank of FIG. 17 showing a carrying handle in use.

FIG. 17 illustrates a blank 410 for forming carton 490, as shown in FIGS. 18 and 19, according to a fifth illustrated embodiment.

The blank 410 comprises a plurality of main panels 412, 414, 416, 418, 420 hingedly connected one to the next in a linear series. A first side panel 414 is hingedly connected to a top panel 416 by a fold line 415. The top panel 416 is hingedly connected to a second side panel 418 by a fold line 417. The second side panel 418 is hingedly connected to a base side panel 420 by a fold line 419. The blank 410 comprises a glue panel 412 hingedly connected to base panel 414 by a fold line 413.

The plurality of main panels 412, 414, 416, 418, 420 of the blank 410 form an open ended tubular structure in a set-up condition.

Each of the ends of the tubular structure is at least partially closed by end closure panels. In the illustrated embodiment the ends of the tubular structure are fully closed by end closure panels 426*a*, 428*a*, 430*a*, 432*a*, 426*b*, 428*b*, 430*b*, 432*b*.

End closure panels 426*a*, 428*a*, 430*a*, 432*a* are configured to close a first end of the tubular structure and end panels 426*b*, 428*b*, 430*b*, 432*b* are configured to close a second end of the tubular structure.

A first end closure panel 426*a* is hingedly connected to a first end of first side panel 414 by a fold line 427*a*. A second end closure panel 428*a* is hingedly connected to a first end of top panel 416 by a fold line 429*a*. A third end closure panel 430*a* is hingedly connected to a first end of second side panel 418 by a fold line 431*a*. A fourth end closure panel 432*a* is hingedly connected to a first end of the base panel 420 by a fold line 433*a*.

A fifth end closure panel 426*b* is hingedly connected to a second end of first side panel 414 by a fold line 427*b*. A sixth end closure panel 428*b* is hingedly connected to a second end of the top panel 416 by a fold line 429*b*. A seventh end closure panel 430*b* is hingedly connected to a second end of second side panel 418 by a fold line 431*b*. An eighth end closure panel 432*b* is hingedly connected to a second end of base panel 418 by a fold line 433*b*.

The blank 410 comprises a first handle structure HA1 struck from the first side panel 414. The blank 410 comprises a second handle structure HA2 struck from the first side panel 418. The blank 410 comprises a first part C1 of a third handle structure C1/C3 struck from the second end closure panel 428*a*. The blank 410 comprises a second part C3 of the third handle structure C1/C3 struck from the fourth end closure panel 432*a*. The blank 410 comprises a first part C2 of a fourth handle structure C2/C4 struck from the fifth end closure panel 428*b*. The blank 410 comprises a second part C4 of the fourth handle structure C2/C4 struck from the eighth end closure panel 432*b*.

The first handle structure HA1 comprises a first tab 444*a* struck from the first side panel 414 and a second tab 444*b* struck from the first side panel 414. The first and second tabs 444*a*, 444*b* are each substantially elongate in shape. The first and second tabs 444*a*, 444*b* are each hingedly connected to the first side panel 414 by fold lines 443*a*, 443*b* respectively. The first and second tabs 444*a*, 444*b* are separated from each other by a severance line such as a cut line 445. In some embodiments the first and second tabs 444*a*, 444*b* are severably connected to each other by a severance line.

The second handle structure HA2 comprises a first tab 444*a* struck from the first side panel 418 and a second tab 444*b* struck from the second side panel 418. The first and second tabs 444*a*, 444*b* are each substantially elongate in shape. The first and second tabs 444*a*, 444*b* are each hingedly connected to the first side panel 418 by fold lines 443*a*, 443*b* respectively. The first and second tabs 444*a*, 444*b* are separated from each other by the cut line 445. In some embodiments the first and second tabs 444*a*, 444*b* are severably connected to each other by a severance line.

The third handle structure C1/C3 comprises the first portion C1 defined in the second end closure panel 428*a* and the second portion C3 defined in the fourth end closure panel 432*a*. The first portion C1 comprises a first tab 446*a* struck from the second end closure panel 428*a* and a second tab 446*b* struck from the second end closure panel 428*a*. The first and second tabs 446*a*, 446*b* are each substantially elongate in shape. The first and second tabs 446*a*, 446*b* are each hingedly connected to the second end closure panel 428*a* by fold lines 447*a*, 447*b* respectively. The first and second tabs 446*a*, 446*b* are separated from each other by a severance line such as a cut line 450*a*. In some embodiments the first and second tabs 446*a*, 446*b* are severably connected to each other by a severance line. The second portion C3 comprises a third tab 448*a* struck from the fourth end closure panel 432*a* and a fourth tab 448*b* struck from the fourth end closure panel 432*a*. The third and fourth tabs 448*a*, 448*b* are each substantially elongate in shape. The third and fourth tabs 448*a*, 448*b* are each hingedly connected to the fourth end closure panel 432*a* by fold lines 449*a*, 449*b* respectively. The third and fourth tabs 448*a*, 448*b* are separated from each other by a severance line such as a cut line 450*b*. In some embodiments the third and fourth tabs 448*a*, 448*b* are severably connected to each other by a severance line.

The first part C1 of the third handle structure C1/C3 and the second part C3 of the third handle structure C1/C3 are arranged such that they are aligned in a set up carton 490. The fold line 447*a* and the fold line 449*a* are substantially collinear. The fold line 447*b* and the fold line 449*b* are substantially collinear. The first tab 446*a* is disposed in partially overlapping relationship with the fourth tab 448*b* and form a composite tab 446*a*/448*b*. The second tab 446*b* is disposed in partially overlapping relationship with the third tab 448*a* and form a composite tab 446*b*/448*a*.

The fourth handle structure C2/C4 comprises the first portion C2 defined in the sixth end closure panel 428*b* and the second portion C4 defined in the eighth end closure panel 432*b*. The first portion C2 comprises a first tab 446*c* struck from the sixth end closure panel 428*b* and a second tab 446*c* struck from the sixth end closure panel 428*b*. The first and second tabs 446*c*, 446*d* are each substantially elongate in shape. The first and second tabs 446*c*, 446*d* are each hingedly connected to the sixth end closure panel 428*b* by fold lines 447*c*, 447*d* respectively. The first and second tabs 446*c*, 446*d* are separated from each other by a severance line such as a cut line 450*c*. In some embodiments the first and second tabs 446*c*, 446*d* are severably connected to each other by a severance line. The second portion C4 comprises a third tab 448*c* struck from the eighth end closure panel 432*b* and a fourth tab 448*d* struck from the eighth end closure panel 432*b*. The third and fourth tabs 448*c*, 448*d* are each substantially elongate in shape. The third and fourth tabs 448*c*, 448*d* are each hingedly connected to the eighth end closure panel 432*b* by fold lines 449*c*, 449*d* respectively. The third and fourth tabs 448*c*, 448*d* are separated from each other by a severance line such as a cut line 450*d*. In some embodiments the third and fourth tabs 448*c*, 448*d* are severably connected to each other by a severance line.

The first part C2 of the fourth handle structure C2/C4 and the second part C4 of the fourth handle structure C2/C4 are arranged such that they are aligned in a set up carton 490. The fold line 447*c* and the fold line 449*a* are substantially collinear. The fold line 447*d* and the fold line 449*d* are substantially collinear. The first tab 446*c* is disposed in partially overlapping relationship with the fourth tab 448*d* and form a composite tab 446*c*/448*d*. The second tab 446*d* is disposed in partially overlapping relationship with the third tab 448*c* and form a composite tab 446*d*/448*c*.

FIG. 18 illustrates the carton 490 formed form the blank 410 of FIG. 17 the first part C1 of the third handle structure C1/C3 and the second part C3 of the third handle structure C1/C3 are arranged such that a third handle structure HA3 is formed in the composite panel 428*a*/432*a* formed from the second and fourth end closure panels 428*a*, 432*a*.

Similarly, the first part C2 of the fourth handle structure C2/C4 and the second part C4 of the fourth handle structure C2/C4 form a fourth handle structure (not shown in FIG. 18) is formed in a composite panel (not shown in FIG. 18) formed from the sixth and eighth end closure panels 428*b*, 432*b*.

Each of the first and second side panels 414, 418 respective handle structure HA1, HA2, and each of the composite end panels 428*a*/432*a*, 428*b*/432*b* comprises a respective handle structure HA3, C2/C4.

The handle structure HA2 forms a handle opening when one or both of the tabs 444*a*, 444*b* are folded internally of the carton 490. Preferably, the handle opening (and the tabs 444*a*, 444*b*) is placed at a position generally aligned with a space or void disposed between an article disposed in the corner of the carton 490 and the adjacent article.

The handle structure HA3 forms a handle opening when one or both of the composite tabs 446*a*/448*b*, 446*b*/448*a* are folded internally of the carton 490. Preferably, the handle opening (and the composite tabs 446*a*/448*b*, 446*b*/448*a*) is placed at a position generally aligned with a space or void disposed between an article disposed in the corner of the carton 490 and the adjacent article.

In the illustrated embodiment in which the array or matrix of articles is 2×2, then each handle opening is located centrally, that is to say equidistant from each side edge of the carton wall within the respective handle opening is defined. In the illustrated embodiment the carton is configured to accommodate articles which have a substantially similar or constant diameter along their tubular axis, each handle opening is located centrally, that is to say equidistant from the top and bottom edges of the carton wall within the respective handle opening is defined. Preferably, each handle opening is oriented such that the longitudinal axis of each handle opening extends along, if not parallel to, the cylindrical axis of the adjacent corner article.

Figure 18A:
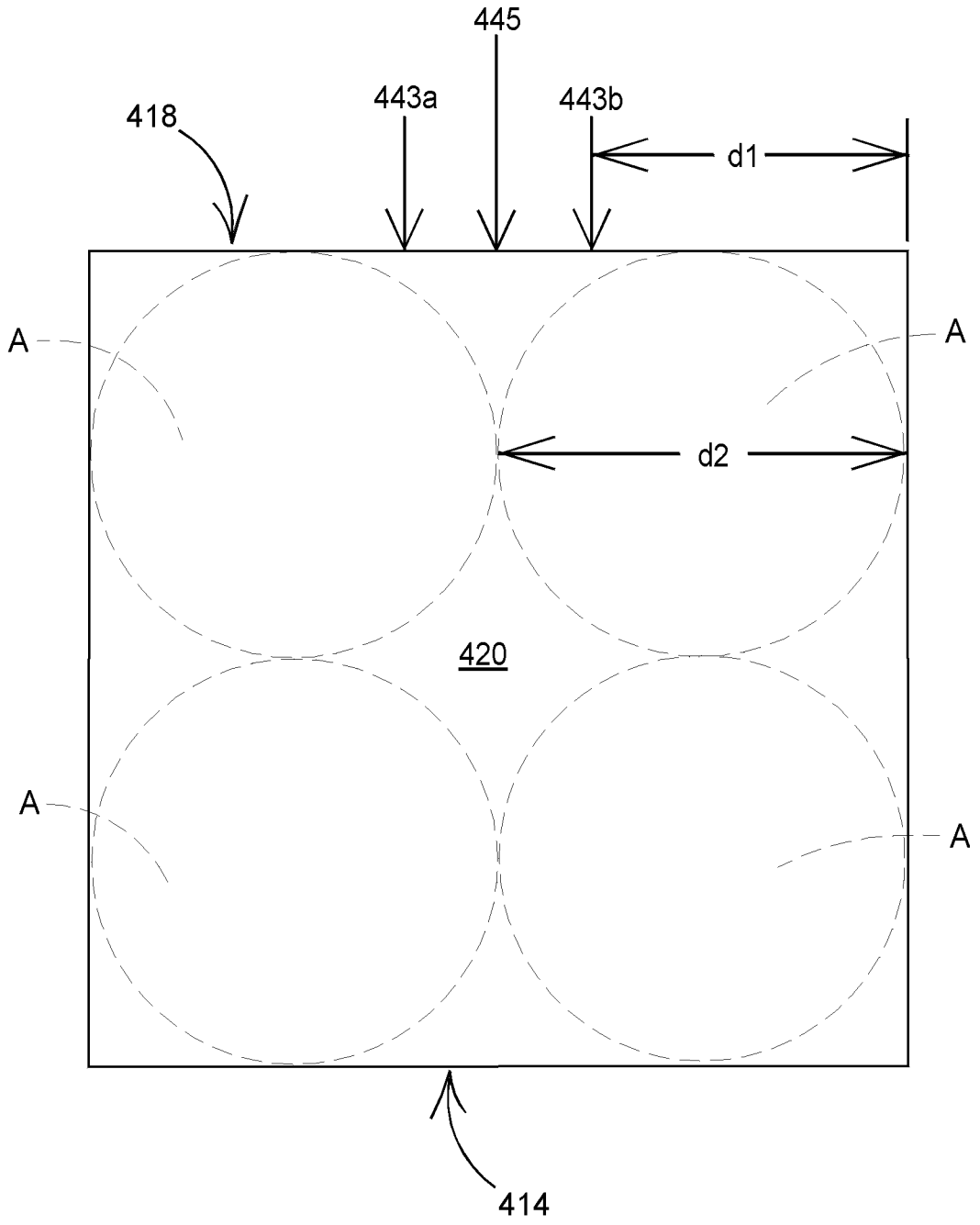
FIG. 18A is a plan view from below of the carton of FIG. 18.

FIG. 18A illustrates a plan view form below of the carton 490, the position of the cut line or severance line 445 is indicated, by the arrow head, with respect to the side panel 418. The position of the fold lines 443*a*, 443*b* are indicated, by the respective arrow heads, with respect to the side panel 418. The position of the articles A upon to the base panel 420 is indicated by the phantom (dashed) lines. The articles A have a diameter at the base of d2. The cut line or severance line 445 is disposed at a distance which is equal to d2 from the end edge of the second side panel 418. The fold line 443*b* is disposed at a distance d1 from the adjacent end edge of the second side panel 418. Distance d1 is less than the diameter d2. Similarly the fold line 443*a* is disposed at a distance from the adjacent end edge of second side panel 418 which is less than the diameter of the base of the adjacently disposed article A.

A user may engage any pair of the handle structures HA1, HA2, HA3, C2/C4 along with an article disposed in the corner of the carton 490 to form a carrying handle, as shown in FIG. 19. As illustrated in FIG. 19 the user may insert a thumb into an opening in the composite end panel 428*a*/432*a* displacing the first and third 446*a*, 448*a* and optionally the second and fourth tabs 446*b*, 448*b* of the third handle structure HA3 internally of the carton 490. The user inserts their fingers into an opening created by displacing the first tab 444*a* and optionally second tab 444*b* of the second handle structure HA2 internally of the carton 490. The user grasps the portion of the second side panel 418 and the portion of the composite end panel 428*a*/432*a* disposed between the second handle structure HA2 and the third handle structure HA3, along with the adjacently disposed article within the carton 490.

Figure 20:
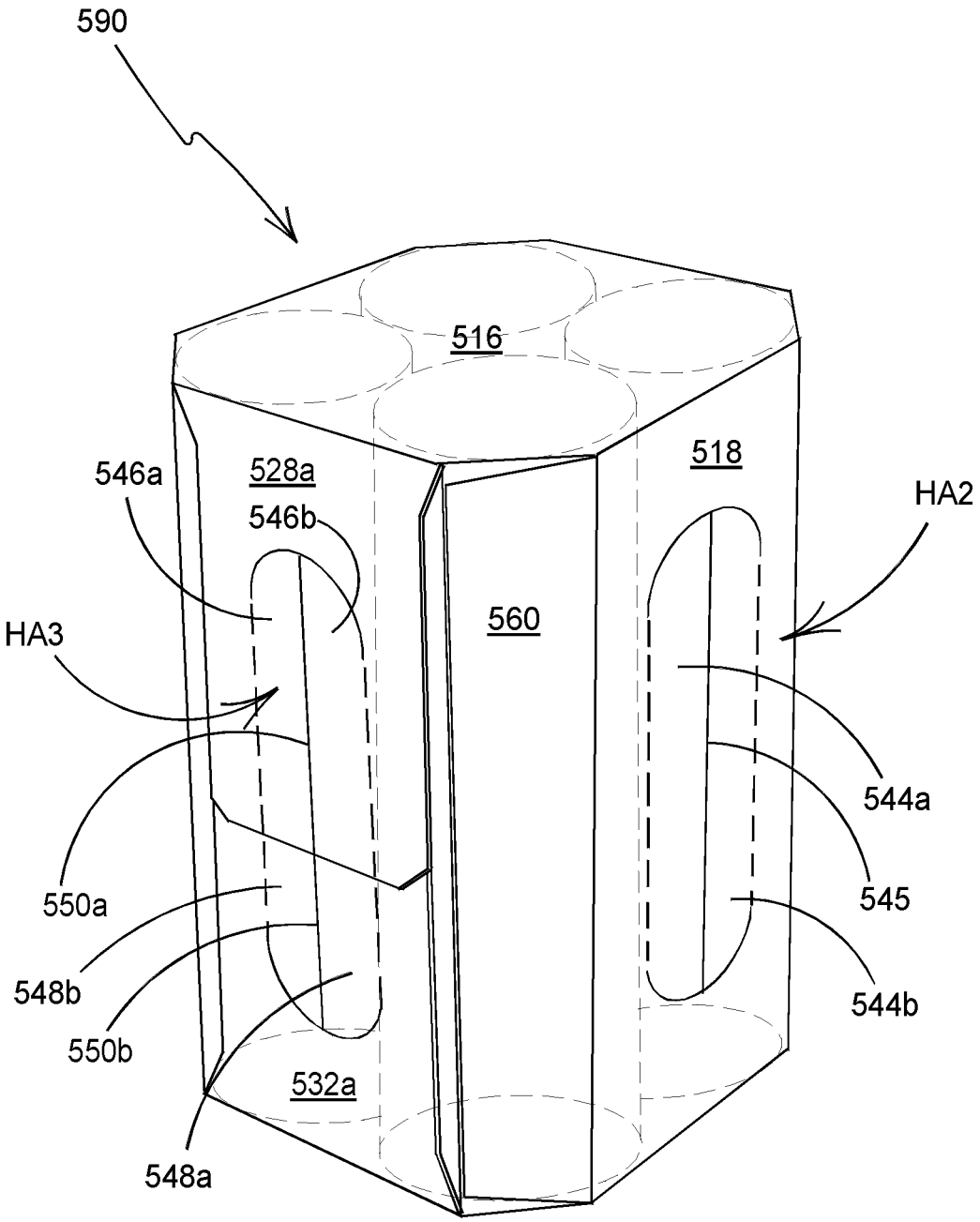
FIG. 20 is a perspective view from above of a carton according to a sixth embodiment.
Figure 21:
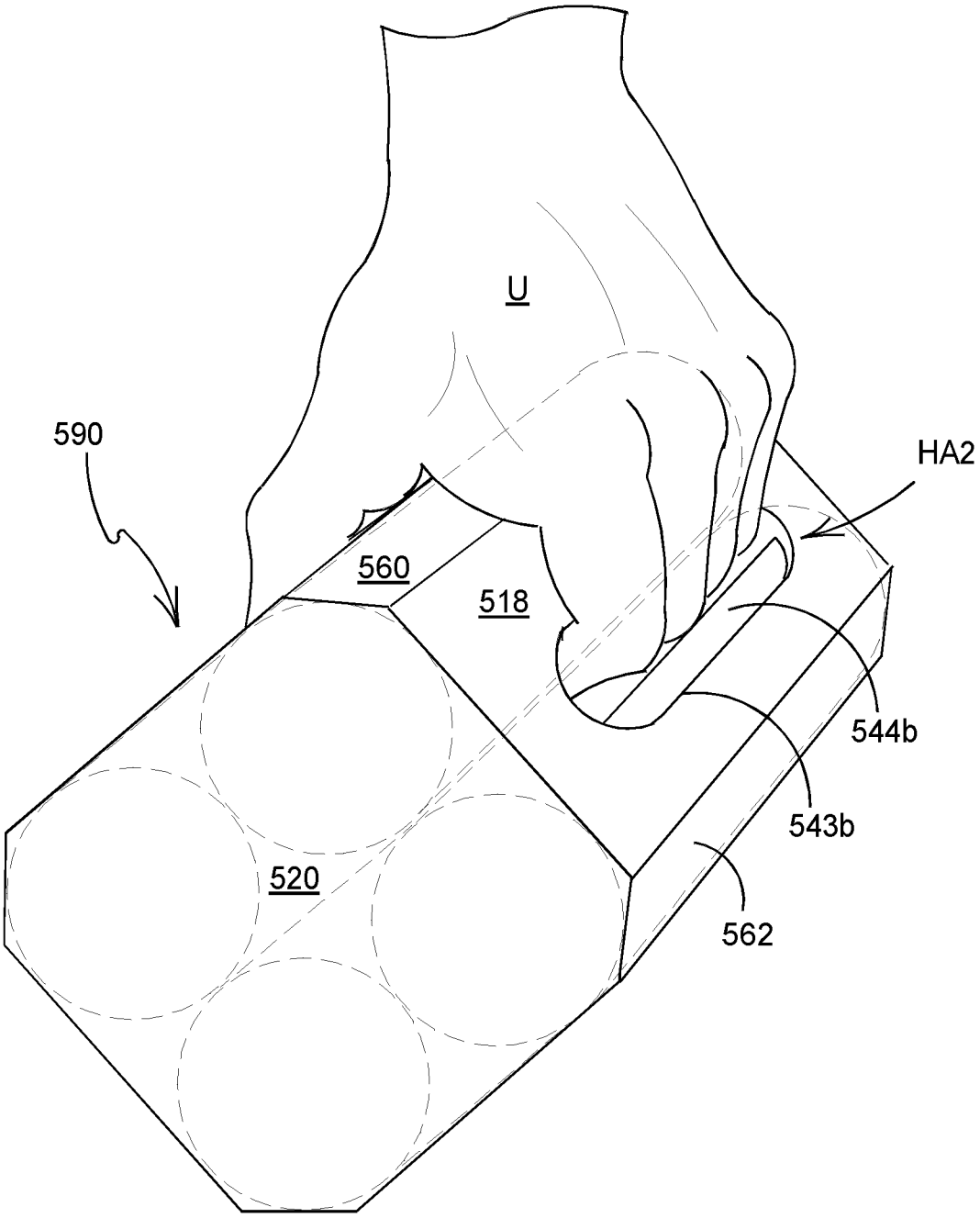
FIG. 21 is a perspective view from above of the carton of FIG. 20 showing a carrying handle in use.

Referring now to FIGS. 20 and 21, there is shown a sixth embodiment of the present invention. The sixth embodiment share many common features with the fifth embodiment and therefore only the differences from the fifth embodiment illustrated in FIGS. 17 to 19 will be described in any greater detail. In the sixth illustrated embodiment, like numerals have, where possible, been used to denote like parts, albeit with the addition of the prefix "400" with "500" and so on to indicate that these features belong to the sixth embodiment.

The carton 590 comprises a bevel or corner panel disposed at each corner of the carton 590. The carton 590 comprises a bevel or corner panel 560 disposed between the second side panel 518 and a first composite end panel 528*a*/532*a*. The carton 590 comprises a bevel or corner panel 562 disposed between the second side panel 518 and a second composite end panel 528*b*/532*b*. The top panel 516 is octagonal in shape. The base panel 520 is octagonal in shape.

The carton 590 comprises a handle structure in each of the first and second side walls and comprises a handle structure in each of the composite end panels 528*b*/532*b*.

A handle structure HA2 forms a handle opening when one or both of the tabs 544*a*, 544*b* are folded internally of the carton 590. Preferably, the handle opening (and the tabs 544*a*, 544*b*) is placed at a position generally aligned with a space or void disposed between an article disposed in the corner of the carton 590 and the adjacent article.

The handle structure HA3 forms a handle opening when one or both of the composite tabs 546*a*/548*b*, 546*b*/548*a* are folded internally of the carton 590. Preferably, the handle opening (and the composite tabs 546*a*/548*b*, 546*b*/548*a*) is placed at a position generally aligned with a space or void disposed between an article disposed in the corner of the carton 590 and the adjacent article.

In the illustrated embodiments in which the array or matrix of articles is 2×2, then each handle opening is located centrally, that is to say equidistant from each side edge of the carton wall within the respective handle opening is defined. In each of the illustrated embodiments where the array or matrix of articles is 2×2 and where the carton is configured to accommodate articles which have a substantially similar or constant diameter along their tubular axis, each handle opening is located centrally, that is to say equidistant from the top and bottom edges of the carton wall within the respective handle opening is defined. Preferably, each handle opening is oriented such that the longitudinal axis of each handle opening extends along, if not parallel to, the cylindrical axis of the adjacent corner article.

One advantage of providing the bevel or corner panels at each corner of the carton 590 between a pair of handle structures HA2, HA3 is that the carrying handle is more comfortable since the user does not have to grasp a sharp corner in their hand.

Figure 22:
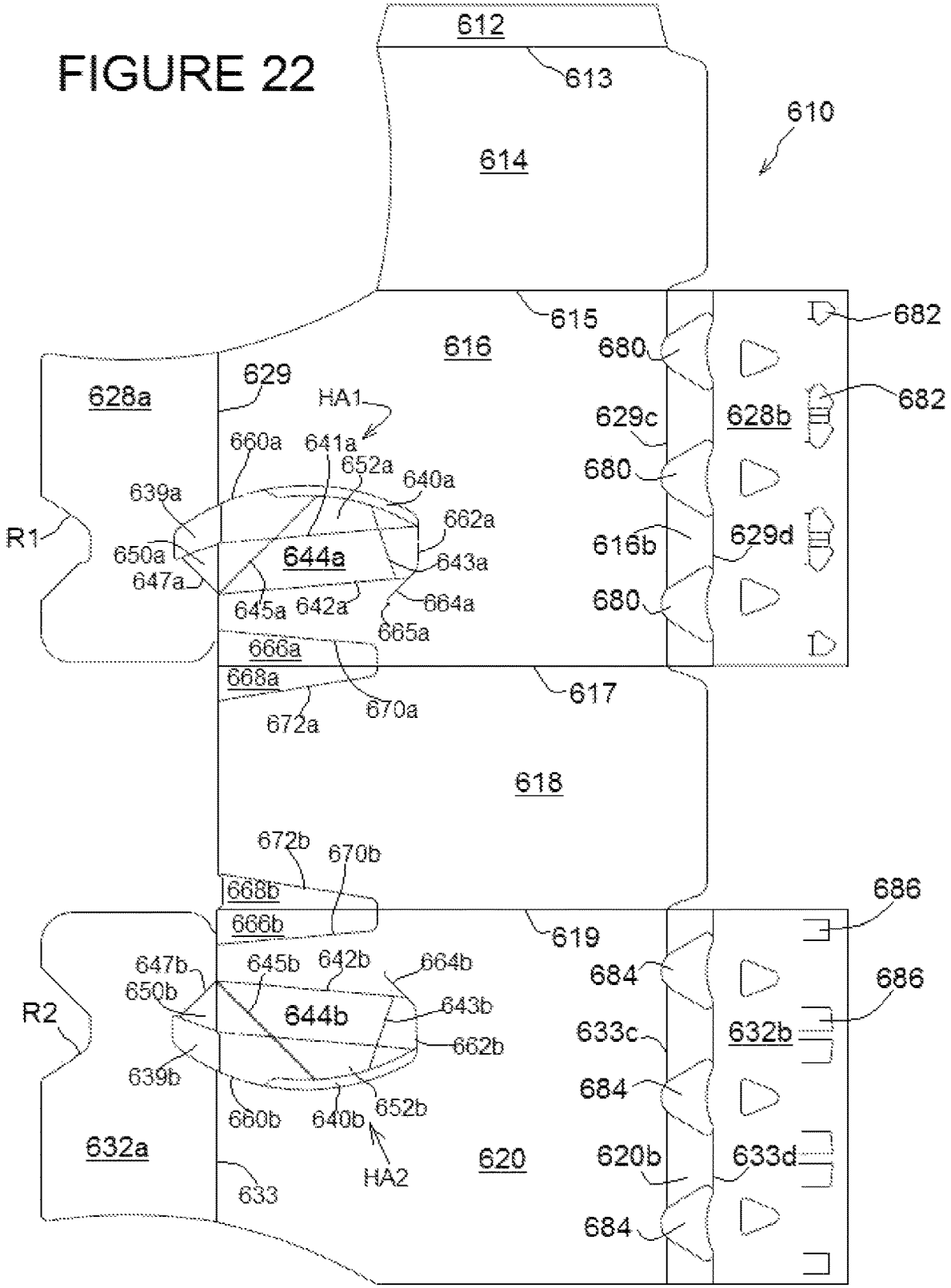
FIG. 22 is a is a plan view from above of a blank for forming a carton according to a seventh embodiment.
Figure 23:
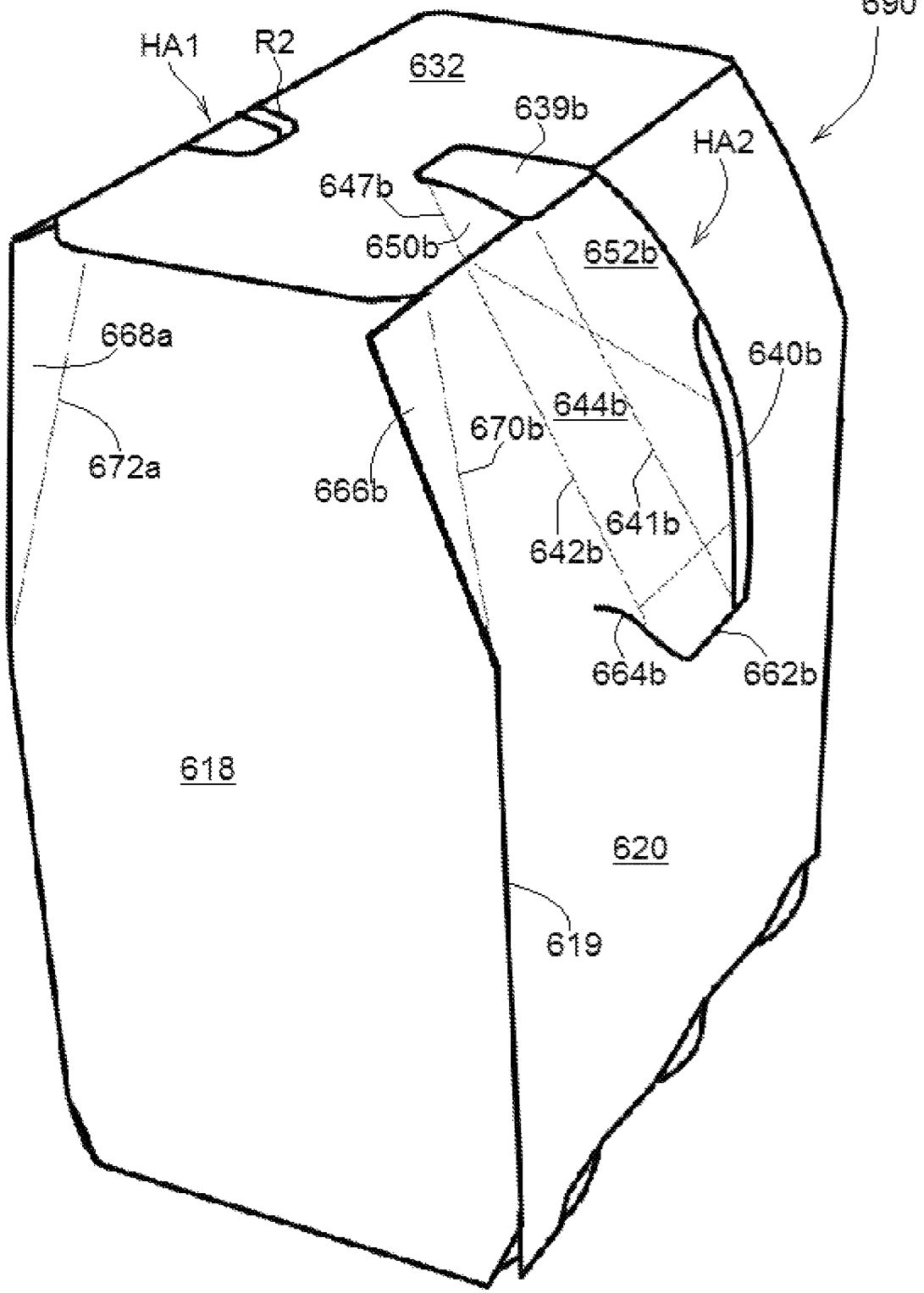
FIG. 23 is a perspective view from above of a carton formed from the blank of FIG. 22.
Figure 24:
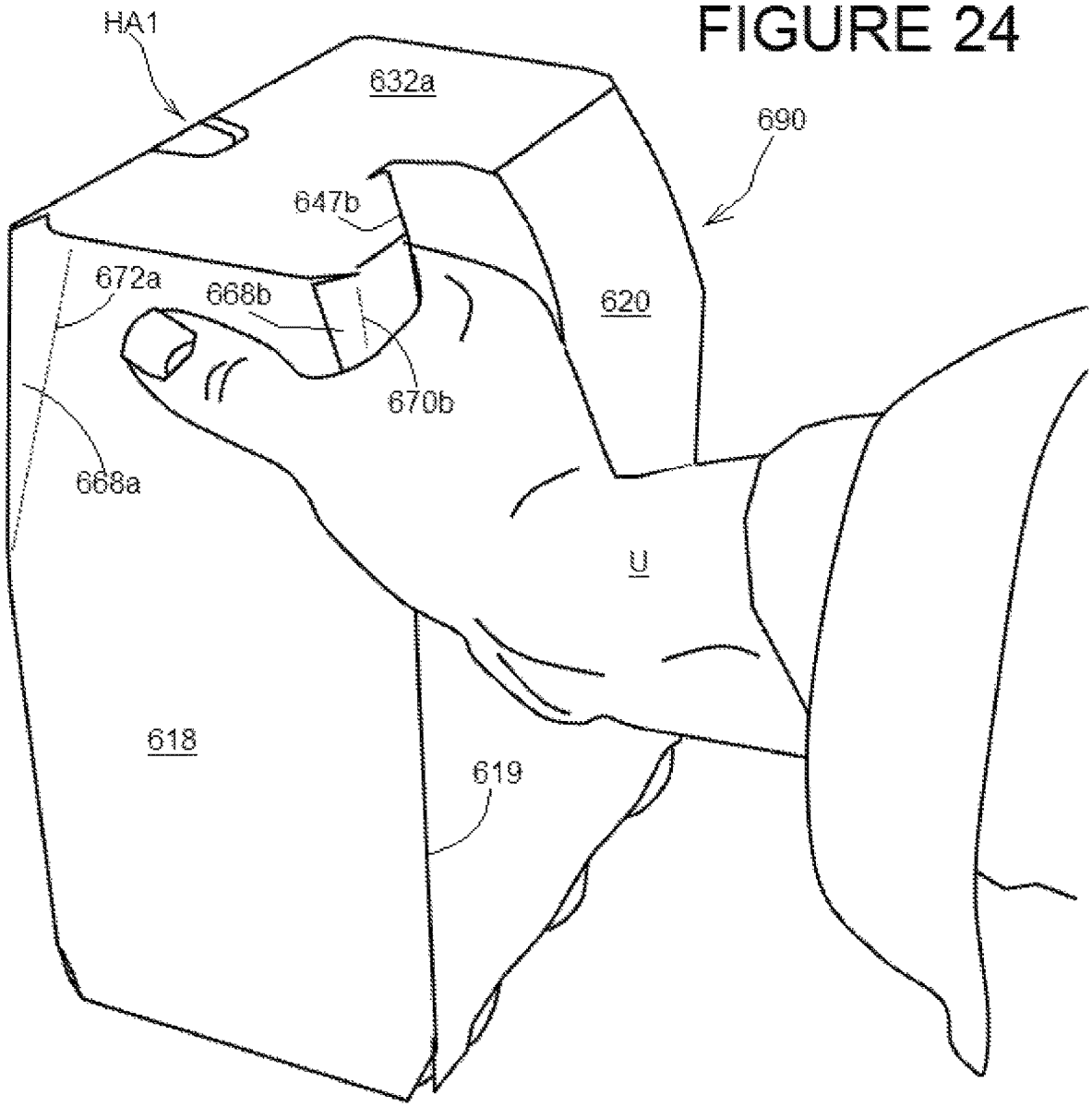
FIG. 24 is a perspective view from above of a carton formed from the blank of FIG. 22 showing a carrying handle in use.

FIGS. 22 to 24 illustrate a blank 610 for forming carton 690, as shown in FIGS. 23 and 24, according to a seven illustrated embodiment. The carton 690 is designed to package six substantially cylindrical necked articles such as bottles of a 2×6 configuration. In the seven illustrated embodiment, like numerals have, where possible, been used to denote like parts, albeit with the addition of the prefix "600" to indicate that these features belong to the seventh embodiment.

The blank 610 comprises a plurality of main panels 612, 614, 616, 618, 620 hingedly connected one to the next in a linear series. The blank 610 comprises a glue panel 612 hingedly connected to a first end panel 614 by a fold line 613. The first end panel 614 is hingedly connected to a first side panel 616 by a fold line 615. The first side panel 616 is hingedly connected to a second end panel 618 by a fold line 617. The second end panel 618 is hingedly connected to a second side panel 620 by a fold line 619.

The plurality of main panels 612, 614, 616, 618, 620 of the blank 610 form a tubular structure with an open top and an open bottom in a set-up condition.

Each of the top and bottom of the tubular structure is at least partially closed by top and bottom closure panels. In the illustrated embodiment, the top and bottom of the tubular structure are substantially closed by top and bottom closure panels 628*a*, 632*a*, 628*b*, 632*b*.

Inner and outer top closure panels 628*a*, 632*a* are configured to close the top of the tubular structure while outer and inner bottom closure panels 628*b*, 632*b* are configured to close the bottom of the tubular structure.

The inner top closure panel 628*a* is hingedly connected to the top end of first side panel 616 by a hinged connection such as a fold line 629. The outer top closure panel 632*a* is hingedly connected to the top end of the second side panel 620 by a hinged connection such as a fold line 633.

The outer bottom closure panel 628*b* is hingedly connected to the bottom end of the first side panel 616 by a hinged connection such as a pair of fold lines 629*c*, 629*d*. A first heel panel 616*b* is defined between the fold lines 629*c*, 629*d*. A plurality of bottom receiving apertures 680 are defined in the first heel panel 616*b* and optionally extend into the first side panel 616. The outer bottom closure panel 628*b* is provided with male locking tabs 682 each struck from the outer bottom closure panel 628*b*. The inner bottom closure panel 632*b* is hingedly connected to the bottom end of the second side panel 620 by a hinged connection such as a pair of fold lines 133*c*, 133*d*. A second heel panel 620*b* is defined between the fold lines 633*c*, 633*d*. A plurality of bottom receiving apertures 684 are defined in the second heel panel 620*b* and optionally extend into the second side panel 620. The inner bottom closure panel 632*b* is provided with female locking tabs 686 each struck from the inner bottom closure panel 632*b*. The female locking tabs 686 define locking apertures in the inner bottom closure panel 632*b* when folded out of the plane of the inner bottom closure panel 632*b*. When the inner and outer bottom closure panels 632*b*, 628*b* are disposed in an overlapping arrangement, the locking apertures in the inner bottom closure panel 632*b* receive the respective locking tabs 682 wherein the female tabs 686 retain the male tabs 682 in the respective locking apertures. By this means, the inner and outer bottom closure panels 632*b*, 628*b* are secured together in the overlapping arrangement.

The blank 610 further comprises a first handle structure HA1 struck (or otherwise formed) in part from the inner top closure panel 628*a*, in part from the first side panel 616 and in part from the second end panel 618. The blank 610 still further comprises a second handle structure HA2 struck (or otherwise formed) in part from the outer top closure panel 632*b*, in part from the second side panel 320 and in part from the second end panel 618. The second handle structure HA2 is similar in construction to the first handle structure HA1, and the first and second handle structures HA1, HA2 will be described by reference to the first handle structure HA1. However, in FIGS. 22 to 24, like numerals have been used to denote like parts of the two handle structures HA1, HA2, albeit with the addition of the suffix "a" to indicate that those elements belong to the first handle structure HA1 and suffix "b" to indicate that those elements belong to the second handle structure HA2.

Referring to FIG. 22, the first handle structure HA1 comprises a first aperture 640*a* defined in the first side panel 616 and a second aperture 639*a* defined in part in the inner top closure panel 628*a* and in part in the first side panel 616. The first handle structure HA1 further comprises a hand tab 644*a* formed from the first side panel 616. The tab 644*a* is substantially elongate in shape and is disposed in registry with a space between a corner bottle and the next adjacent bottle positioned next to the first side panel 616. The tab 644*a* is hingedly connected to the first side panel 616 by a first fold line 642*a*. The tab 644*a* comprises a second fold line 641*a* which extends longitudinally across the tab 644*a* from an upper edge to a lower edge. The second fold line 641*a* is substantially parallel to the first fold line 642*a* and defines in part an outer portion 652*a* of the tab 644*a*. The outer portion 652*a*, in this embodiment, extends from the second fold line 641*a* to the first side panel 616 and detachably connected thereto by a severance line 660*a*. As such, the first aperture 640*a* is separated from the second aperture 639*a* by the outer portion 652*a*. The tab 644*a* comprises a third fold line 643*a* which extends across the tab 644*a* from a first side edge defined by the first fold line 642*a* to a second opposing side edge defined by the first aperture 640*a*. The third fold line 643*a* defines in part a lower portion of the tab 644*a*.

A web panel 650*a* is hingedly connected to the inner top closure panel 628*a* by a fourth fold line 647*a*. The fourth fold line 647*a* is arranged convergent with respect to the fold line 629. The fourth fold line 647*a* intersects or meets with the fold line 629 at its first end and intersects or meets with the first fold line 642*a* at the first end. The web panel 650*a* is triangular in shape and is defined in part by the fold line 629, in part by fourth fold line 647*a* and in part by the second aperture 639*a*. The web panel 650*a* is hingedly connected to the upper edge of the hand tab 644*a* along a fold line 629.

The tab 644*a* comprises a sixth fold line 645*a* which extends from the first side edge of the tab 644*a* defined by the first fold line 642*a* to the second opposing side edge defined by the first aperture 640*a*. The sixth fold line 645*a* extends from a vertex defined by the fourth fold line 647*a*, the fold line 629 and the first fold line 642*a*.

The third fold line 643*a* and the sixth fold line 645*a* are arranged divergently with respect to each other and diverge towards the first edge of the tab 644*a* defined by the first fold line 642*a*. The lower edge of the hand tab 644*a* is detachably connected to the first side panel 616 along a severance line 662*a*. The severance line 662*a* extends from the first aperture 640*a* to the lower end of the first fold line 642*a*. However, the first handle structure HA1 is further provided with a relief severance line 664*a* such as a cut line. The relief severance line 664*a* emanates from the vertex of the severance line 662*a* and the first fold line 642*a* generally toward a cushioning panel 666*a* and terminates in a downturned, curled end 665*a*. The cushioning panel 666*a* is generally trapezoidal in shape and connects between the upper portion of the first side panel 616 and a gusset panel 668*a*. The cushioning panel 666*a* is hingedly connected to the first side panel 616 by a generally L-shaped fold line 670*a* and to the gusset panel 668*a* by the fold line 617. The gusset panel 668*a* is similar in shape to the cushioning panel 666*a* in that the gusset panel 668*a* is less in width somewhat than the cushioning panel 666*a* and equal in vertical length to the cushioning panel 666*a*. The gusset panel is connected to the second end panel 618 by a fold line 672*a*. The cushioning panel 666*a* and the gusset panel 668*a* are brought into face-contacting arrangement with each other when the blank 610 is erected into a carton and together provide a foldable hand cushion which constitutes part of the first handle structure HA1.

The blank 610 further comprises a first recess R1 struck from the inner top closure panel 628*a*. The first recess R1 is struck from a free edge of the inner top closure panel 628*a*. The first recess R1 is configured such that when the blank 610 is in an assembled state, the first recess R1 is disposed under the web panel 650*b* and second aperture 639*b* of the second handle structure HA2 in alignment therewith. The first recess R1 is shaped and dimensioned such that the web panel 650*b* of the second handle structure HA2 can pass through the inner top closure panel 628*a* when folded internally of the erected carton 690 as best shown in FIG. 24.

The blank 610 further comprises a second recess R2 struck from the outer top closure panel 632*a*. The second recess R2 is struck from a free edge of the outer top closure panel 632*a*. The second recess R2 is configured such that when the blank 610 is in an assembled state, the second recess R2 is disposed over the web panel 650*a* and second aperture 639*a* of the first handle structure HA1 in alignment therewith. The second recess R2 is shaped and dimensioned to remove a portion of the outer top closure panel 632*a* that could otherwise be disposed over the web panel 650*a* of the first handle structure HA1 such that such a portion does not interfere with user's hand when the web panel 650*a* is folded internally of the carton 690.

FIGS. 23 and 24 illustrate a carton 690 formed from the blank 610. The carton 690 may be formed by a series of sequential folding operations in a straight line machine in a manner substantially the same as that described earlier in relation to the embodiment of FIGS. 1 to 3. The primary differences between the seven the embodiment and the first embodiment are as follows: (1) There are only two closure panels for closing each end of the carton 690; (2) the bottom end closure panels 628*b*, 632*b* are secured together by the mechanical locking device provided by the male and female tabs 682, 686; (3) the carton 690 is a top loading carton; (4) the first end panel 614 is a partial end panel that closes the lower area of that end and leaves the upper area of that end open; and (5) the upper portion of the second end panel 618 is disposed at a recessed position due to the gusset panels 668, as shown in FIGS. 23 and 24.

FIG. 24 shows the second handle structure HA2 in an operative condition. The second handle structure HA2 once first deployed remains in a deployed condition for subsequent reuse by a user. In FIG. 24, a user "U" has folded the tab 644*b* about the first fold line 642*b* and outer portion 652*b* of the hand tab 644*b* about the second fold line 641*b*. In doing so, the tab 644*b* has been displaced inwardly of the carton 690; the tab 644*b* is wrapped or folded, at least in part, about the neck of a necked article B disposed at the corner of the carton 690.

The handle structure HA2 forms a handle opening when the tab 644*b* is folded internally of the carton 690. Preferably, the handle opening (and the tab 644*b*) is placed at a position generally aligned with a space or void disposed between the neck of the corner article at the corner of the carton 690 and the neck of the adjacent article. In the illustrated embodiment in which the array or matrix of articles is greater than 2×3, each handle opening may be located closer to the carton top than to the carton bottom and to the recessed end (618) of the carton 690 than to the partially closed end of the carton 690. Preferably, each handle opening is oriented such that the longitudinal axis of each handle opening extends along, if not parallel to, the cylindrical axis of the adjacent corner article.

A user can employ the second handle structure HA2 as a carrying handle by placing a thumb against the second end panel 618 and inserting their fingers into the carton 690 through the opening formed by displacing the hand tab 644*b*. The web panel 650*b* has been folded about fold line 647*b* out of the plane of the outer top panel 632*a* to be disposed internally of the carton 690. The user may wrap their hand and/or fingers about the first fold line 642*b* and the second fold line 641*b*. The user may wrap their hand and/or fingers about the tab 644*b* and outer portion 652*b* of the tab 644*b*. The tab 644*b* forms an ergonomic comfortable carrying handle in combination with the neck of the corner article B. The web panel 650*b* restricts the range of movement of the upper portion of the tab 644*b* internally of the carton 690. The proximity with which a user may place their hand to the neck of the corner article is thereby limited. This reduces the likelihood of the user grasping the closure device (e.g., a cap/crown) of the article. Additionally or alternatively the web panel 650*b* shields the users hand from the closure device of the article.

The gusset panel 668*b* that has been folded into face-contacting arrangement with the cushioning panel 666*b* cooperate with the cushioning panel 666*b* to serve as a hand cushion when they are folded about the fold line 670*b* toward the other gusset panel 668*a*.

The third fold line 643*b* allows a lower portion of the tab 644*b* to be folded over a shoulder portion of the corner article such that the tab 644*b* may deform about a shoulder of the corner article. In this way the upper portion of tab 644*b* can be readily brought to bear against a neck portion of the corner article.

The tab 644*b* may be in frictional engagement with the corner article. Such frictional engagement facilitates retention of the tab 644*b* in the folded, operative condition.

It can be appreciated that various changes may be made within the scope of the present invention. For example, the size and shape of the panels and apertures may be adjusted to accommodate articles of differing size or shape. The glue panel may take the form of a second top panel disposed outermost, the top panel being secured to an inner face of the second top panel.

It can be appreciated that various changes may be made within the scope of the present invention, for example, the size and shape of the panels and apertures may be adjusted to accommodate articles of differing size or shape. In embodiments of the invention the tabs 44*a*, 44*b*, 144*a*, 144*b*, 244*a*, 244*b*, 344*a*, 344*b*, 444*a*, 444*b*, 446*a*, 446*c*, 446*d*, 446*b*, 448*a*, 448*b*, 448*c*, 448*d*, 544*a*, 544*b*, 548*a*, 548*b*, 644*a*, 644*b*, 650*a*, 650*b* may be omitted. In embodiments of the invention the thumb tabs 46*a*, 46*b* may be omitted.

In some embodiments the carton 490, 590 may comprise less than four handle structures, for example the carton 490, 590 may comprise a pair of handle structures disposed in adjacently disposed walls of the carton 490, 590. In some embodiments a handle structure may be provided in the top panel and/or in the base panel and in at least one of the side or end walls of the carton 490, 590 such that a user may grasp a corner of the carton 490, 590; in such embodiments the articles such as cans or bottles may be disposed in rolling contact with the base panel 420, 520. That is to say, the articles have a substantially cylindrical shape having a cylindrical axis which is orientated so as to extend perpendicularly between a pair of opposed side or end walls of the carton 490, 590. In those embodiments having less than four handle structures the carton 590 may comprise fewer bevel or corner panels, such that a bevel or corner panel is only provided between a pair of adjacent side and end walls, each wall of said pair of adjacent side and end walls having a handle structure.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the term "hinged connection" refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines.

As used herein, the term "fold line" refers to one of the following: a scored line, an embossed line, a debossed line, a line of perforations, a line of short slits, a line of half-cuts, a single half-cut, an interrupted cut line, aligned slits, a line of scores and any combination of the aforesaid options.

As used herein, the term "severance line" refers to all manner of lines formed in a substrate of sheet material, that facilitate separating portions of the substrate from one another, or otherwise indicate optimal separation locations on the substrate. For example, a severance line in a substrate of sheet material is predisposed to allow a tear to propagate there along. A severance line may be one of the following: a single cut, a single half-cut, a single slit, an interrupted cut, a score line, an interrupted score line, a line of perforations, a line of short cuts, a line of short slits, a line of short half cuts, and any combination of the aforementioned options.

It should be understood that hinged connections, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A package comprising a carton and a plurality of articles, the plurality of articles comprising a plurality of bottles, the carton comprising a plurality of carton panels and a carrying handle, the carrying handle comprising a handle structure formed from at least one of the carton panels, the handle structure comprising a tab struck from the at least one of the carton panels, the tab being hingedly connected, by a hinged connection, to the at least one of the carton panels and arranged to fold at least in part about a first bottle disposed in a corner of the carton to define at least in part a first handle opening in the at least one of the carton panels, the first handle opening extending in a longitudinal direction that is substantially parallel to the cylindrical axis of the first bottle, and the first handle opening being aligned with a void disposed between a tapered neck portion of the first bottle and a tapered neck portion of a second adjacent bottle so as to allow a user to grasp the tapered neck portion of the first bottle as well as a portion of the carton disposed adjacent to the first bottle to carry the carton.

2. The package according to claim 1 wherein the hinged connection comprises a first fold line for facilitating folding of the tab about the first bottle, the first fold line extending in a longitudinal direction that is substantially parallel to the cylindrical axis of the first bottle.

3. The package according to claim 1 wherein the at least one of the carton panels comprises a first one of the carton panels, and the handle structure comprises a web panel coupling the tab to a second one of the carton panels, the second one of the carton panels being disposed adjacent to, and at an angle with respect to, the first one of the carton panels.

4. The package according to claim 3 wherein the second one of the carton panels is disposed substantially perpendicularly to the first one of the carton panels.

5. The carrying handle according to claim 1 wherein a thumb opening is provided in a third one of the carton panels, the third one of the carton panels being disposed adjacent to the first one of the carton panels.

6. The carrying handle according to claim 5 wherein the thumb opening is defined at least in part by a thumb tab, the thumb tab being at least partially detachable from the third the one of the carton panels.

7. The carrying handle according to claim 5 wherein the thumb opening is defined at least in part by a thumb tab, the thumb tab being hingedly connected to the third one of the carton panels.

8. The carrying handle according to claim 1 wherein a lower edge of the tab is shaped so as to accommodate a portion of the first article when the tab is folded internally of the carton.

9. The carrying handle according to claim 1 wherein a lower edge of the tab is defined by an aperture, the aperture forming part of the first handle opening, the aperture being struck from at least one of the plurality of panels.

10. The package according to claim 1 wherein the tab comprises a fold line extending transversely thereacross so as to allow a lower portion of the tab to fold about a portion of the first bottle when the tab is folded internally of the carton.

11. The package according to claim 1 wherein a side edge of the tab is defined by an aperture, the aperture forming part of the first handle opening, the aperture being struck at least from the at least one of the carton panels.

12. The package according to claim 1 wherein at least a portion of an upper edge of the tab is defined by an aperture, the aperture forming part of the handle opening, the at least one of the carton panels being a first one of the carton panels, the aperture being struck at least from a second one of the carton panels, the second one of the carton panels being disposed adjacent to the first one of the carton panels, such that the first handle opening is defined in the first one of the carton panels and in the second one of the carton panels.

13. The carrying handle according to claim 1 wherein the at least one of the carton panels comprises a first one of the carton panels, the handle structure comprises an extension panel hingedly connected to the tab and formed at least in part form a second one of the carton panels, the second one of the carton panels being disposed adjacent to the first one of the carton panels.

14. The carrying handle according to claim 13 wherein the extension panel is coupled to the second one of the carton panels by a hinged connection.

15. The package according to claim 1 wherein the at least one of the carton panels is a composite panel formed from two or more panels disposed in at least partial overlapping relationship with one another, a first one of the two or more panels comprising the tab and a second one of the two or more panels comprises a cutaway arranged in registry with the tab so as to allow the tab to pass through the second one of the two or more panels when folded.

16. The carrying handle according to claim 1 wherein the handle structure comprises a second tab struck from the at least one of the carton panels, the second tab being hingedly connected, by a hinged connection, to the at least one of the carton panels and arranged to fold with respect to the at least one of the carton panels to form the first handle opening.

17. A carton comprising the carrying handle of claim 1 wherein a handle structure is struck from a side wall of the carton.

18. A package comprising a carton and a plurality of articles, the plurality of articles comprising a plurality of bottles, the carton comprising a plurality of carton walls including a top wall, a base wall, a first side wall, a second side wall, a first end wall and a second end wall, the carton comprising at least one handle structure formed from at least one of the carton walls, the at least one handle structure comprising a tab struck from the at least one of the carton walls, the tab being hingedly connected, by a hinged connection, to the at least one of the carton walls and arranged to fold at least in part about a first bottle disposed in a corner of the carton to form at least a portion of a handle opening, the hinged connection comprising a first fold line for facilitating folding of the tab about the first bottle, the first fold line extending in a longitudinal direction that is substantially parallel to the cylindrical axis of the first bottle, handle opening being aligned with a void disposed between a tapered neck portion of the first bottle and a tapered neck portion of a second adjacent bottle so as to allow a user to place their hand about the corner of the carton and to grasp the tapered neck portion of the first bottle as well as a portion of the carton disposed adjacent to the first bottle to carry the carton.

* * * * *